US008467274B2

(12) United States Patent
Aoki

(10) Patent No.: US 8,467,274 B2
(45) Date of Patent: Jun. 18, 2013

(54) HAND POSITION DETECTING DEVICE AND ELECTRONIC TIMEPIECE

(75) Inventor: Nobuhiro Aoki, Kokubunji (JP)

(73) Assignee: Casio Computer Co., Ltd, Tokyo (JP)

( * ) Notice: Subject to any disclaimer, the term of this patent is extended or adjusted under 35 U.S.C. 154(b) by 407 days.

(21) Appl. No.: 12/952,824

(22) Filed: Nov. 23, 2010

(65) Prior Publication Data

US 2011/0141858 A1 Jun. 16, 2011

(30) Foreign Application Priority Data

Dec. 10, 2009 (JP) ..... 2009-279986

(51) Int. Cl.
*G04B 19/04* (2006.01)
*G04C 9/00* (2006.01)

(52) U.S. Cl.
USPC ..... 368/80; 368/187

(58) Field of Classification Search
USPC ..... 368/80–81, 187, 220–222
See application file for complete search history.

(56) References Cited

U.S. PATENT DOCUMENTS 4,358,753 A * 11/1982 Cascini ..... 341/2
5,999,495 A * 12/1999 Hashizume et al. ..... 368/80
6,038,523 A * 3/2000 Akahane et al. ..... 702/150
6,807,128 B2 * 10/2004 Yiu ..... 368/220
7,859,952 B2 * 12/2010 Aoki ..... 368/80
8,023,362 B2 * 9/2011 Suizu et al. ..... 368/81
2009/0086580 A1 4/2009 Aoki

FOREIGN PATENT DOCUMENTS

EP 0 841 538 A1 5/1998
EP 2 042 946 A2 4/2009
GB 2 197 968 A 6/1988
JP 2001-296144 10/2001
JP 2009085674 4/2009

OTHER PUBLICATIONS

Japanese Office Action for Japanese Application No. 2009-279986 mailed on Oct. 25, 2011.
Partial European Search Report for European Application No. 10194010.4 mailed on Jun. 17, 2011.
Extended European Search Report for European Application No. 10194010.4-1240 dated Aug. 16, 2011.

* cited by examiner

*Primary Examiner* — Sean Kayes
(74) *Attorney, Agent, or Firm* — Turocy & Watson, LLP

(57) ABSTRACT

A hand position detecting device including: a first gear rotating with a minute hand; a second gear rotating with a second hand; a first detection target portion that is provided on the first gear and identifiable by light irradiation; a second detection target portion that is provided on the second gear and identifiable by light irradiation; and a detector, wherein the second detection target portion is formed to be divided into a plurality of parts over a predetermined angular range out of a center angle of 360° of the second gear, and a presence-or-absence pattern of the second detection target portion in an angular range of successive N (N represents one of 5 to 10) angular segments with any angular segment being set as a start point is made different when the angular segment of the start point is different.

20 Claims, 22 Drawing Sheets

FIG.4

1: HOLE IS PROVIDED
0: NO HOLE IS PROVIDED

| SECOND POSITION | 00 | 02 | 04 | 06 | 08 | 10 | 12 | 14 | 16 | 18 | 20 | 22 | 24 | 26 | 28 | 30 | 32 | 34 | 36 | 38 | 40 | 42 | 44 | 46 | 48 | 50 | 52 | 54 | 56 | 58 |
|---|---|---|---|---|---|---|---|---|---|---|---|---|---|---|---|---|---|---|---|---|---|---|---|---|---|---|---|---|---|---|
| HOLE PATTERN | 1 | 0 | 0 | 1 | 1 | 1 | 1 | 1 | 0 | 1 | 1 | 1 | 0 | 0 | 1 | 0 | 1 | 1 | 0 | 0 | 0 | 0 | 0 | 1 | 0 | 0 | 0 | 1 | 1 | 0 |

FIG.10

| HAND SHIFT AMOUNT | TIMING | SECOND HOLE PATTERN | $Y_0$ | $Y_1$ | $Y_2$ | $Y_3$ | $Y_4$ |
|---|---|---|---|---|---|---|---|
| +6 | 54 MINUTE 00 SECOND | A | 1 | 0 | 0 | 1 | 1 |
| +5 | 54 MINUTE 10 SECOND | B | 1 | 1 | 1 | 0 | 1 |
| +4 | 54 MINUTE 20 SECOND | C | 1 | 1 | 0 | 0 | 1 |
| +3 | 54 MINUTE 30 SECOND | D | 0 | 1 | 1 | 0 | 0 |
| +2 | 54 MINUTE 40 SECOND | E | 0 | 0 | 0 | 1 | 0 |
| +1 | 54 MINUTE 50 SECOND | F | 0 | 0 | 1 | 1 | 0 |
| 0 | 55 MINUTE 00 SECOND | A | 1 | 0 | 0 | 1 | 1 |
| -1 | 55 MINUTE 10 SECOND | B | 1 | 1 | 1 | 0 | 1 |
| -2 | 55 MINUTE 20 SECOND | C | 1 | 1 | 0 | 0 | 1 |
| -3 | 55 MINUTE 30 SECOND | D | 0 | 1 | 1 | 0 | 0 |
| -4 | 55 MINUTE 40 SECOND | E | 0 | 0 | 0 | 1 | 0 |
| -5 | 55 MINUTE 50 SECOND | F | 0 | 0 | 1 | 1 | 0 |

1: HOLE IS PROVIDED
0: NO HOLE IS PROVIDED

| SECOND POSITION | 00 | 02 | 04 | 06 | 08 | 10 | 12 | 14 | 16 | 18 | 20 | 22 | 24 | 26 | 28 | 30 | 32 | 34 | 36 | 38 | 40 | 42 | 44 | 46 | 48 | 50 | 52 | 54 | 56 | 58 |
|---|---|---|---|---|---|---|---|---|---|---|---|---|---|---|---|---|---|---|---|---|---|---|---|---|---|---|---|---|---|---|
| HOLE PATTERN | 1 | 0 | 1 | 1 | 1 | 0 | 0 | 1 | 1 | 1 | 1 | 1 | 0 | 1 | 1 | 0 | 1 | 0 | 0 | 0 | 1 | 1 | 0 | 0 | 0 | 0 | 0 | 1 | 0 | 0 |

1: HOLE IS PROVIDED
0: NO HOLE IS PROVIDED

| SECOND POSITION | 00 | 02 | 04 | 06 | 08 | 10 | 12 | 14 | 16 | 18 | 20 | 22 | 24 | 26 | 28 | 30 | 32 | 34 | 36 | 38 | 40 | 42 | 44 | 46 | 48 | 50 | 52 | 54 | 56 | 58 |
|---|---|---|---|---|---|---|---|---|---|---|---|---|---|---|---|---|---|---|---|---|---|---|---|---|---|---|---|---|---|---|
| HOLE PATTERN | 1 | 0 | 0 | 0 | 1 | 1 | 1 | 1 | 1 | 0 | 1 | 1 | 0 | 0 | 1 | 0 | 1 | 1 | 1 | 0 | 0 | 0 | 0 | 0 | 1 | 0 | 0 | 1 | 1 | 0 |

1: HOLE IS PROVIDED
0: NO HOLE IS PROVIDED

| SECOND POSITION | 00 | 02 | 04 | 06 | 08 | 10 | 12 | 14 | 16 | 18 | 20 | 22 | 24 | 26 | 28 | 30 | 32 | 34 | 36 | 38 | 40 | 42 | 44 | 46 | 48 | 50 | 52 | 54 | 56 | 58 |
|---|---|---|---|---|---|---|---|---|---|---|---|---|---|---|---|---|---|---|---|---|---|---|---|---|---|---|---|---|---|---|
| HOLE PATTERN | 1 | 0 | 1 | 1 | 1 | 1 | 1 | 0 | 1 | 1 | 0 | 0 | 0 | 1 | 1 | 0 | 1 | 0 | 0 | 0 | 0 | 0 | 1 | 0 | 0 | 1 | 1 | 1 | 0 | 0 |

1: HOLE IS PROVIDED
0: NO HOLE IS PROVIDED

| SECOND POSITION | 00 | 02 | 04 | 06 | 08 | 10 | 12 | 14 | 16 | 18 | 20 | 22 | 24 | 26 | 28 | 30 | 32 | 34 | 36 | 38 | 40 | 42 | 44 | 46 | 48 | 50 | 52 | 54 | 56 | 58 |
|---|---|---|---|---|---|---|---|---|---|---|---|---|---|---|---|---|---|---|---|---|---|---|---|---|---|---|---|---|---|---|
| HOLE PATTERN | 1 | 0 | 0 | 0 | 1 | 1 | 1 | 1 | 1 | 0 | 1 | 0 | 0 | 1 | 1 | 0 | 1 | 1 | 1 | 0 | 0 | 0 | 0 | 0 | 1 | 0 | 1 | 1 | 0 | 0 |

1: HOLE IS PROVIDED
0: NO HOLE IS PROVIDED

| SECOND POSITION | 00 | 02 | 04 | 06 | 08 | 10 | 12 | 14 | 16 | 18 | 20 | 22 | 24 | 26 | 28 | 30 | 32 | 34 | 36 | 38 | 40 | 42 | 44 | 46 | 48 | 50 | 52 | 54 | 56 | 58 |
|---|---|---|---|---|---|---|---|---|---|---|---|---|---|---|---|---|---|---|---|---|---|---|---|---|---|---|---|---|---|---|
| HOLE PATTERN | 1 | 0 | 0 | 1 | 0 | 0 | 0 | 1 | 1 | 0 | 0 | 0 | 0 | 0 | 1 | 0 | 1 | 1 | 0 | 1 | 1 | 1 | 0 | 0 | 1 | 1 | 1 | 1 | 1 | 0 |

1: HOLE IS PROVIDED
0: NO HOLE IS PROVIDED

| SECOND POSITION | 00 | 02 | 04 | 06 | 08 | 10 | 12 | 14 | 16 | 18 | 20 | 22 | 24 | 26 | 28 | 30 | 32 | 34 | 36 | 38 | 40 | 42 | 44 | 46 | 48 | 50 | 52 | 54 | 56 | 58 |
|---|---|---|---|---|---|---|---|---|---|---|---|---|---|---|---|---|---|---|---|---|---|---|---|---|---|---|---|---|---|---|
| HOLE PATTERN | 1 | 0 | 0 | 1 | 1 | 1 | 1 | 1 | 0 | 1 | 0 | 0 | 0 | 1 | 1 | 0 | 1 | 1 | 0 | 0 | 0 | 0 | 0 | 1 | 0 | 1 | 1 | 1 | 0 | 0 |

1: HOLE IS PROVIDED
0: NO HOLE IS PROVIDED

| SECOND POSITION | 00 | 02 | 04 | 06 | 08 | 10 | 12 | 14 | 16 | 18 | 20 | 22 | 24 | 26 | 28 | 30 | 32 | 34 | 36 | 38 | 40 | 42 | 44 | 46 | 48 | 50 | 52 | 54 | 56 | 58 |
|---|---|---|---|---|---|---|---|---|---|---|---|---|---|---|---|---|---|---|---|---|---|---|---|---|---|---|---|---|---|---|
| HOLE PATTERN | 1 | 0 | 1 | 1 | 1 | 0 | 1 | 1 | 0 | 0 | 0 | 0 | 0 | 1 | 1 | 0 | 1 | 0 | 0 | 0 | 1 | 0 | 0 | 1 | 1 | 1 | 1 | 1 | 0 | 0 |

1: HOLE IS PROVIDED
0: NO HOLE IS PROVIDED

| SECOND POSITION | 00 | 02 | 04 | 06 | 08 | 10 | 12 | 14 | 16 | 18 | 20 | 22 | 24 | 26 | 28 | 30 | 32 | 34 | 36 | 38 | 40 | 42 | 44 | 46 | 48 | 50 | 52 | 54 | 56 | 58 |
|---|---|---|---|---|---|---|---|---|---|---|---|---|---|---|---|---|---|---|---|---|---|---|---|---|---|---|---|---|---|---|
| HOLE PATTERN | 1 | 0 | 1 | 1 | 0 | 0 | 0 | 1 | 0 | 0 | 0 | 0 | 0 | 1 | 1 | 0 | 1 | 0 | 0 | 1 | 1 | 1 | 0 | 1 | 1 | 1 | 1 | 1 | 0 | 0 |

1: HOLE IS PROVIDED
0: NO HOLE IS PROVIDED

| SECOND POSITION | 00 | 02 | 04 | 06 | 08 | 10 | 12 | 14 | 16 | 18 | 20 | 22 | 24 | 26 | 28 | 30 | 32 | 34 | 36 | 38 | 40 | 42 | 44 | 46 | 48 | 50 | 52 | 54 | 56 | 58 |
|---|---|---|---|---|---|---|---|---|---|---|---|---|---|---|---|---|---|---|---|---|---|---|---|---|---|---|---|---|---|---|
| HOLE PATTERN | 1 | 0 | 0 | 1 | 0 | 0 | 0 | 0 | 0 | 1 | 1 | 0 | 0 | 0 | 1 | 0 | 1 | 1 | 0 | 1 | 1 | 1 | 1 | 1 | 0 | 0 | 1 | 1 | 1 | 0 |

1: HOLE IS PROVIDED
0: NO HOLE IS PROVIDED

| SECOND POSITION | 00 | 02 | 04 | 06 | 08 | 10 | 12 | 14 | 16 | 18 | 20 | 22 | 24 | 26 | 28 | 30 | 32 | 34 | 36 | 38 | 40 | 42 | 44 | 46 | 48 | 50 | 52 | 54 | 56 | 58 |
|---|---|---|---|---|---|---|---|---|---|---|---|---|---|---|---|---|---|---|---|---|---|---|---|---|---|---|---|---|---|---|
| HOLE PATTERN | 1 | 0 | 1 | 1 | 0 | 0 | 1 | 0 | 0 | 0 | 0 | 0 | 1 | 1 | 1 | 0 | 1 | 0 | 0 | 1 | 1 | 0 | 1 | 1 | 1 | 1 | 1 | 0 | 0 | 0 |

1: HOLE IS PROVIDED
0: NO HOLE IS PROVIDED

| SECOND POSITION | 00 | 02 | 04 | 06 | 08 | 10 | 12 | 14 | 16 | 18 | 20 | 22 | 24 | 26 | 28 | 30 | 32 | 34 | 36 | 38 | 40 | 42 | 44 | 46 | 48 | 50 | 52 | 54 | 56 | 58 |
|---|---|---|---|---|---|---|---|---|---|---|---|---|---|---|---|---|---|---|---|---|---|---|---|---|---|---|---|---|---|---|
| HOLE PATTERN | 1 | 0 | 0 | 1 | 1 | 1 | 0 | 0 | 1 | 0 | 0 | 0 | 0 | 0 | 1 | 0 | 1 | 1 | 0 | 0 | 0 | 1 | 1 | 0 | 1 | 1 | 1 | 1 | 1 | 0 |

1: HOLE IS PROVIDED
0: NO HOLE IS PROVIDED

| SECOND POSITION | 00 | 02 | 04 | 06 | 08 | 10 | 12 | 14 | 16 | 18 | 20 | 22 | 24 | 26 | 28 | 30 | 32 | 34 | 36 | 38 | 40 | 42 | 44 | 46 | 48 | 50 | 52 | 54 | 56 | 58 |
|---|---|---|---|---|---|---|---|---|---|---|---|---|---|---|---|---|---|---|---|---|---|---|---|---|---|---|---|---|---|---|
| HOLE PATTERN | 1 | 0 | 0 | 1 | 1 | 0 | 1 | 0 | 0 | 0 | 0 | 0 | 1 | 1 | 1 | 0 | 1 | 1 | 0 | 0 | 1 | 0 | 1 | 1 | 1 | 1 | 1 | 0 | 0 | 0 |

1: HOLE IS PROVIDED
0: NO HOLE IS PROVIDED

| SECOND POSITION | 00 | 02 | 04 | 06 | 08 | 10 | 12 | 14 | 16 | 18 | 20 | 22 | 24 | 26 | 28 | 30 | 32 | 34 | 36 | 38 | 40 | 42 | 44 | 46 | 48 | 50 | 52 | 54 | 56 | 58 |
|---|---|---|---|---|---|---|---|---|---|---|---|---|---|---|---|---|---|---|---|---|---|---|---|---|---|---|---|---|---|---|
| HOLE PATTERN | 1 | 0 | 1 | 1 | 1 | 1 | 1 | 0 | 0 | 1 | 1 | 1 | 0 | 1 | 1 | 0 | 1 | 0 | 0 | 0 | 0 | 0 | 1 | 1 | 0 | 0 | 0 | 1 | 0 | 0 |

1: HOLE IS PROVIDED
0: NO HOLE IS PROVIDED

| SECOND POSITION | 00 | 02 | 04 | 06 | 08 | 10 | 12 | 14 | 16 | 18 | 20 | 22 | 24 | 26 | 28 | 30 | 32 | 34 | 36 | 38 | 40 | 42 | 44 | 46 | 48 | 50 | 52 | 54 | 56 | 58 |
|---|---|---|---|---|---|---|---|---|---|---|---|---|---|---|---|---|---|---|---|---|---|---|---|---|---|---|---|---|---|---|
| HOLE PATTERN | 1 | 0 | 0 | 1 | 1 | 1 | 0 | 1 | 0 | 0 | 0 | 0 | 0 | 1 | 1 | 0 | 1 | 1 | 0 | 0 | 0 | 1 | 0 | 1 | 1 | 1 | 1 | 1 | 0 | 0 |

1: HOLE IS PROVIDED
0: NO HOLE IS PROVIDED

| SECOND POSITION | 00 | 02 | 04 | 06 | 08 | 10 | 12 | 14 | 16 | 18 | 20 | 22 | 24 | 26 | 28 | 30 | 32 | 34 | 36 | 38 | 40 | 42 | 44 | 46 | 48 | 50 | 52 | 54 | 56 | 58 |
|---|---|---|---|---|---|---|---|---|---|---|---|---|---|---|---|---|---|---|---|---|---|---|---|---|---|---|---|---|---|---|
| HOLE PATTERN | 1 | 0 | 0 | 1 | 1 | 1 | 1 | 1 | 0 | 0 | 1 | 0 | 0 | 0 | 1 | 0 | 1 | 1 | 0 | 0 | 0 | 0 | 0 | 1 | 1 | 0 | 1 | 1 | 1 | 0 |

1: HOLE IS PROVIDED
0: NO HOLE IS PROVIDED

| SECOND POSITION | 00 | 02 | 04 | 06 | 08 | 10 | 12 | 14 | 16 | 18 | 20 | 22 | 24 | 26 | 28 | 30 | 32 | 34 | 36 | 38 | 40 | 42 | 44 | 46 | 48 | 50 | 52 | 54 | 56 | 58 |
|---|---|---|---|---|---|---|---|---|---|---|---|---|---|---|---|---|---|---|---|---|---|---|---|---|---|---|---|---|---|---|
| HOLE PATTERN | 1 | 0 | 0 | 0 | 1 | 0 | 1 | 0 | 0 | 1 | 1 | 1 | 1 | 1 | 1 | 0 | 1 | 1 | 1 | 0 | 1 | 0 | 1 | 1 | 0 | 0 | 0 | 0 | 0 | 0 |

1: HOLE IS PROVIDED
0: NO HOLE IS PROVIDED

| SECOND POSITION | 00 | 02 | 04 | 06 | 08 | 10 | 12 | 14 | 16 | 18 | 20 | 22 | 24 | 26 | 28 | 30 | 32 | 34 | 36 | 38 | 40 | 42 | 44 | 46 | 48 | 50 | 52 | 54 | 56 | 58 |
|---|---|---|---|---|---|---|---|---|---|---|---|---|---|---|---|---|---|---|---|---|---|---|---|---|---|---|---|---|---|---|
| HOLE PATTERN | 1 | 0 | 0 | 0 | 1 | 0 | 1 | 0 | 1 | 1 | 1 | 1 | 1 | 1 | 1 | 0 | 1 | 1 | 1 | 0 | 1 | 0 | 1 | 0 | 0 | 0 | 0 | 0 | 0 | 0 |

1: HOLE IS PROVIDED
0: NO HOLE IS PROVIDED

| SECOND POSITION | 00 | 02 | 04 | 06 | 08 | 10 | 12 | 14 | 16 | 18 | 20 | 22 | 24 | 26 | 28 | 30 | 32 | 34 | 36 | 38 | 40 | 42 | 44 | 46 | 48 | 50 | 52 | 54 | 56 | 58 |
|---|---|---|---|---|---|---|---|---|---|---|---|---|---|---|---|---|---|---|---|---|---|---|---|---|---|---|---|---|---|---|
| HOLE PATTERN | 1 | 0 | 0 | 0 | 0 | 0 | 1 | 1 | 1 | 1 | 1 | 1 | 1 | 1 | 1 | 0 | 1 | 1 | 1 | 1 | 1 | 0 | 0 | 0 | 0 | 0 | 0 | 0 | 0 | 0 |

1: HOLE IS PROVIDED
0: NO HOLE IS PROVIDED

| SECOND POSITION | 00 | 02 | 04 | 06 | 08 | 10 | 12 | 14 | 16 | 18 | 20 | 22 | 24 | 26 | 28 | 30 | 32 | 34 | 36 | 38 | 40 | 42 | 44 | 46 | 48 | 50 | 52 | 54 | 56 | 58 |
|---|---|---|---|---|---|---|---|---|---|---|---|---|---|---|---|---|---|---|---|---|---|---|---|---|---|---|---|---|---|---|
| HOLE PATTERN | 1 | 0 | 0 | 0 | 0 | 0 | 1 | 1 | 1 | 1 | 1 | 1 | 1 | 1 | 1 | 0 | 1 | 1 | 1 | 1 | 1 | 0 | 0 | 0 | 0 | 0 | 0 | 0 | 0 | 0 |

1: HOLE IS PROVIDED
0: NO HOLE IS PROVIDED

| SECOND POSITION | 00 | 02 | 04 | 06 | 08 | 10 | 12 | 14 | 16 | 18 | 20 | 22 | 24 | 26 | 28 | 30 | 32 | 34 | 36 | 38 | 40 | 42 | 44 | 46 | 48 | 50 | 52 | 54 | 56 | 58 |
|---|---|---|---|---|---|---|---|---|---|---|---|---|---|---|---|---|---|---|---|---|---|---|---|---|---|---|---|---|---|---|
| HOLE PATTERN | 1 | 0 | 0 | 0 | 0 | 1 | 1 | 1 | 1 | 1 | 1 | 1 | 1 | 1 | 1 | 0 | 1 | 1 | 1 | 1 | 0 | 0 | 0 | 0 | 0 | 0 | 0 | 0 | 0 | 0 |

HAND POSITION DETECTING DEVICE AND ELECTRONIC TIMEPIECE

CROSS-REFERENCE TO RELATED APPLICATIONS

This application is based upon and claims the benefit of priority from the prior Japanese Patent Application No. 2009-279986, filed on Dec. 10, 2009, the entire contents of which are incorporated herein by reference.

BACKGROUND OF THE INVENTION

1. Field of the Invention

The present invention relates to a hand position detecting device for detecting the position of a hand (or a pointer) and an electronic timepiece.

2. Description of the Related Art

There has been hitherto developed a hand position detecting device for detecting the position of a hand to check whether the hand is positionally displaced or not (for example, see JP-A-2009-85674).

In a conventional hand position detecting device, a second hand and a minute hand are detected as follows, for example. That is, one through hole is provided in a minute hand wheel rotating interlockingly with the minute hand, and one through hole and an elongated hole extending over a fixed angle range are provided in a second hand wheel rotating interlockingly with the second hand. Furthermore, the hands and gearwheels are assembled with one another so that the through hole of the minute hand wheel and the through hole of the second hand wheel are overlapped with each other at a detection position at a specified time (for example, every hour 55 minute 00 second). A photointerruptor or the like is made to detect overlap or non-overlap between the through hole of the minute hand wheel and the through hole or elongated hole of the second hand wheel from the specified time for a fixed time period for which the minute hand is stopped (for example, ten seconds), thereby judging whether position displacement occurs between the minute hand or the second hand or not.

For example, by providing the elongated hole of the second hand wheel from a position which is far away from the through hole by ten steps, after the overlap between the through holes is detected at a specified time, the overlap of the through holes is not detected while the second hand wheel is rotated by two, four, six and eight steps, but the overlap between the through hole of the minute hand wheel and the elongated hole of the second hand wheel is detected at the position corresponding to the ten steps when there is no positional displacement in the hands. On the other hand, when there is any positional displacement in the second hand or the minute hand, the detection pattern from the specified time till 10 steps as described above is not obtained. Accordingly, the presence or absence of the positional displacement in the minute hand or the second hand can be determined by judging whether this detection pattern is obtained or not.

In a process of fabricating an electronic timepiece, after all gear wheels are moved to reference positions, the hands are assembled so as to be oriented in predetermined positions (called as hands mounting). In this case, the hands may be assembled while slightly positionally displaced. The conspicuous degree of assembling error of each hand is not equal among all the hands, and the minute hand is particularly more conspicuous in property. This is because the minute hand has a small rotational angle per step and has such a length as to be lean to scales on a dial. For example, in a case where the minute hand is assembled with a displacement of "−2°", the minute hand is set to be displaced from the scale of twelve o'clock on the dial by "−2°" when the time of the timepiece is "00 minute 00 second", and the minute hand is set to be just overlapped with the scale of twelve o'clock when the time of the timepiece is "00 minute 20 second". Visually comparing these states, a user recognizes the assembling error of the minute hand.

With respect to a conventional electronic timepiece having no hand position detecting mechanism, when an assembling error of the minute hand as described above occurs, the error can be eliminated by adjusting the reference position of the minute hand wheel. That is, even when the minute hand is assembled with a displacement of "−2°", the position at which the minute hand wheel is rotated from the above state by two steps is regarded as the reference position of the minute hand wheel, whereby the minute hand can be set so that the time at which the minute hand is just overlapped with the scale of twelve o'clock on the dial is equal to the counted time "00 minute 00 second".

However, with respect to an electronic timepiece having the conventional hand position detecting mechanism described above, the assembling error of the minute hand cannot be eliminated by adjusting the reference position of the minute hand wheel. For example, it is assumed that the minute hand is assembled to be displaced from the scale of twelve o'clock by "−2°" when the through hole of the minute hand wheel is overlapped with the detection position, and also it is assumed that the specified time at which the detection of the through hole is performed is adjusted and set to "59 minute 40 second" in conformity with the displacement of "−2°" of the minute hand. In this case, at the specified time, the through hole of the minute hand wheel is overlapped with the detection position, and also the second hand wheel is set so that the position corresponding to "40 seconds" is overlapped with the detection position. Accordingly, when the detecting operation is executed from the specified time every two steps per ten seconds, the detection pattern such as detection-non-detection -non-detection-non-detection-non-detection-detection of transmitted light as described above is not obtained, and for example, there is obtained a detection pattern with which it cannot be specified which position the second hand wheel is located at like detection-detection-detection-detection -detection-detection of transmitted light because the elongated hole of the second hand wheel is overlapped with the detection position. Accordingly, in the electronic timepiece having the conventional hand position detecting mechanism, when the assembling error of the minute hand occurs, the minute hand must be detached and then mounted with high precision again.

The present invention provides a hand position detecting device and an electronic timepiece that can perform hand position detection according to the same algorithm even when the timing of the hand position detection is varied due to assembling error of a minute hand or the like.

SUMMARY OF THE INVENTION

A preferable embodiment of the present invention is a hand position detecting device characterized by comprising: a first gear rotating interlockingly with a minute hand; a second gear rotating interlockingly with a second hand and rotating about a same rotational axis as the first gear; a first detection target portion that is provided at a predetermined radial position of the first gear and identifiable by light irradiation; a second detection target portion that is provided at a radial position of the second gear so as to be overlapped with the first detection target portion and identifiable by light irradiation; and a detector for detecting on the basis of irradiated light whether the first detection target portion and the second detection target portion are set to be overlapped with each other at a predetermined detection position, wherein the second detection target portion is formed to be divided into a plurality of parts over a predetermined angular range out of a center angle of 360° of the second gear, and a presence-or-absence pattern of the second detection target portion in an angular range of successive N (N represents one of 5 to 10) angular segments each having a center angle of 12° with any angular segment being set as a start point is made different when the angular segment of the start point is different.

BRIEF DESCRIPTION OF THE DRAWINGS

FIG. 4 is a table showing an angular position of every two steps of the second hand wheel and a pattern of through holes in association with each other.

FIG. 10 is a table showing the association relation of a hand shift amount caused by assembling error, hourly examination timing and a second hole pattern as a comparative target.

DESCRIPTION OF THE PREFERRED EMBODIMENT

An embodiment according to the present invention will be described with reference to the drawings.

Figure 1:
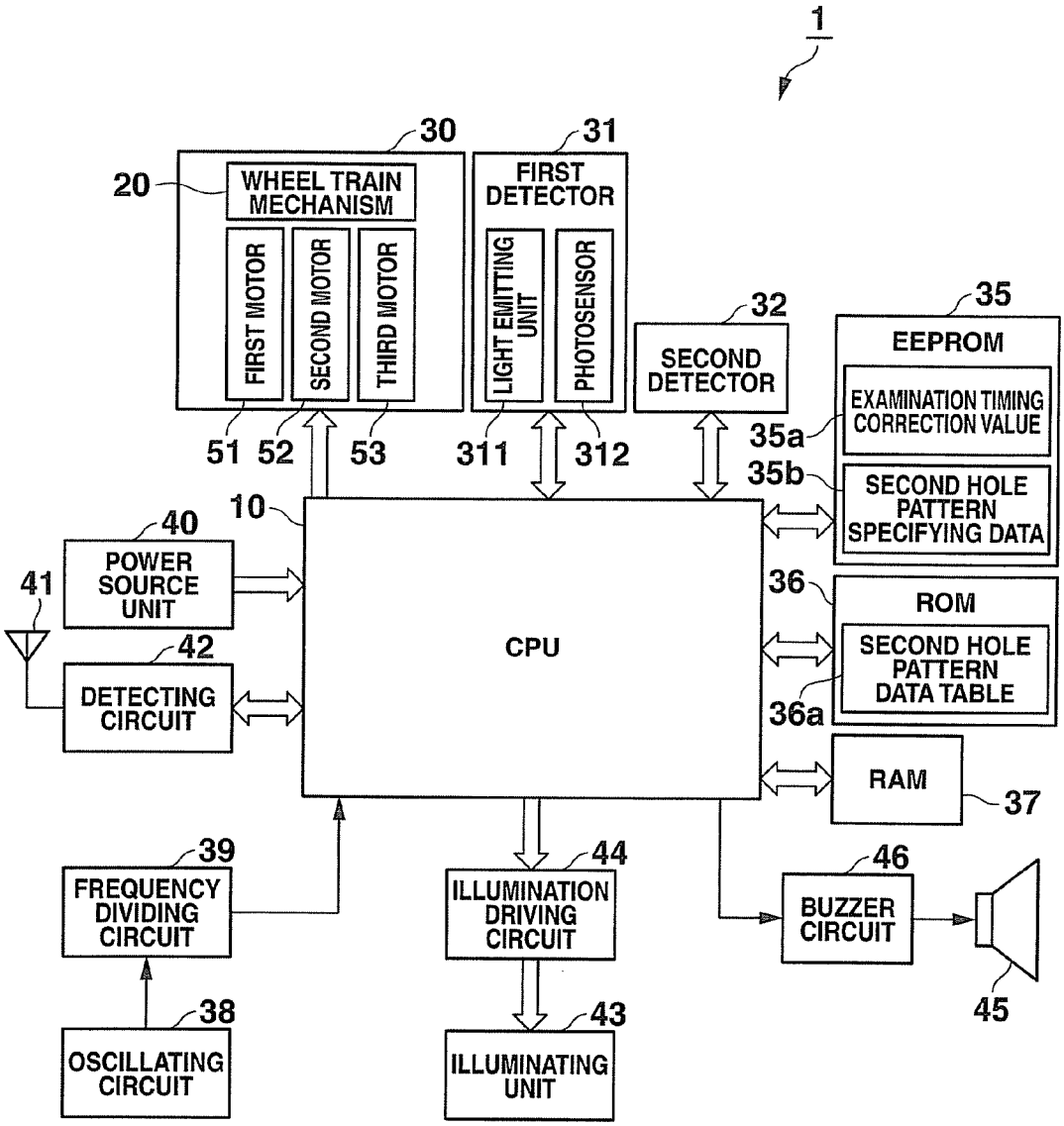
FIG. 1 is a block diagram showing the overall construction of an electronic timepiece according to an embodiment of the present invention.
Figure 2:
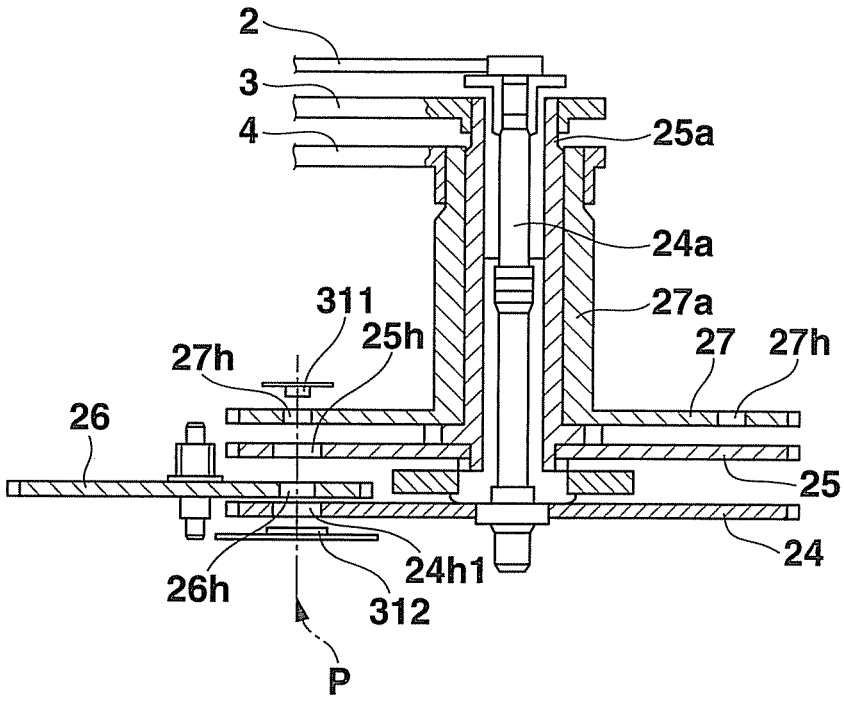
FIG. 2 is a cross-sectional view showing a mechanism portion according to hand position detection.

FIG. 1 is a block diagram showing the overall construction of an electronic timepiece according to an embodiment of the present invention. FIG. 2 is a cross-sectional view showing a mechanism portion associated with hand position detection.

The electronic timepiece 1 of this embodiment has an analog display unit for displaying the time by rotating a second hand 2, a minute hand 3 and a hour hand 4 (see FIG. 2) through electrical driving, and serves as a main body of a wrist watch, for example.

As shown in FIG. 1, this electronic timepiece 1 has CPU (Central Processing Unit) 10 for performing overall control of the timepiece, a movement 30 for driving the respective hands (second hand, minute hand, hour hand) 2 to 4, a first detector 31 for detecting the positions of the second hand 2 and the minute hand 3, a second detector 32 for detecting the position of the hour hand 4, RAM (Random Access Memory) 37 for supplying a working memory area to CPU 10, ROM (Read Only Memory) 36 in which control programs to be executed by CPU 10 and control data are stored, EEPROM (Electrically Erasable Programmable ROM) 35 in which control data are stored, a power source unit 40 for supplying an operating voltage to each unit, an antenna 41 and a detecting circuit 42 for receiving standard radio waves for correcting the time, an oscillating circuit 38 and a frequency dividing circuit 39 for supplying a signal having a predetermined frequency to CPU 10, an illuminating unit 43 and an illumination driving circuit 44 for illuminating the analog display unit in darkness, a speaker 45 and a buzzer circuit 46 for outputting an alarm, etc.

The movement 30 is provided with a first motor 51 for driving the second hand 2, a second motor 52 for driving the minute hand 3, and a third motor 53 for driving the hour hand 4. Each of the first to third motors 51 to 53 is a stepping motor having a bipolar stator and a bipolar rotor.

The movement 30 is provided with a wheel train mechanism 20 for transmitting the rotational motion of the first to third motors 51 to 53 to the respective hands 2 to 4. As shown in FIG. 2, the wheel train mechanism 20 contains a second hand wheel 24 as a second gear to which the second hand 2 is fixed through a second hand shaft 24*a*, a minute hand wheel 25 as a first gear to which the minute hand 3 is fixed through a minute hand shaft 25*a*, a hour hand wheel 27 to which the hour hand 4 is fixed through a hour hand shaft 27*a*, and an intermediate wheel 26 as a third gear which rotates interlockingly with the minute hand wheel 25. The second hand wheel 24, the minute hand wheel 25 and the hour hand wheel 27 are independently rotatable about the same rotational axis by the driving force of the first to third motors 51 to 53.

In this embodiment, as described later in detail, the wheel train mechanism 20 is assembled so that the second hand wheel 24 rotates one round by 60-step rotation of the first motor 51, the minute hand wheel 25 rotates one round by 360-step rotation of the second motor 52, and the hour hand wheel 27 rotates one round by 360-step rotation of the third motor 53.

As shown in FIG. 2, the first detector 31 comprises a light emitting unit 311 for emitting light from one side and a photosensor 312 as a detector for receiving the light at the other side which are disposed so as to sandwich the second hand wheel 24, the minute hand wheel 25, the intermediate wheel 26 and the hour hand wheel 127 therebetween. The light emitting unit 311 comprises a light emitting diode, for example, and the photosensor 312 comprises a phototransistor or the like, for example. The light emitting unit 311 and the photosensor 312 are fixed on the frame portion of the housing of the electronic timepiece 1 so as to confront each other at a preset detection position P. The detection position P is not limited to a specific one, and it is set at the position corresponding to twelve o'clock on the dial, for example.

The second detector 32 detects a through hole of another gear rotating interlockingly with the hour hand 4. It comprises a light emitting unit and a photosensor as in the case of the first detector 31, and is disposed at a second detection position P2 (see FIG. 7).

In ROM 36 are stored a time display processing program for driving the first to third motors 51 to 53 at proper timings while counting a signal transmitted from the frequency diving circuit 39 to drive the hands 2 to 4 and display the time, a hand position detecting and correcting processing program for checking on the basis of satisfaction of a predetermined condition whether positional displacement occurs in the respective hands 2 to 4 or not and correcting the position when there is any positional displacement, etc. Furthermore, a second hole pattern data table (the same data as a table of FIG. 4 described later) in which a formation pattern of through holes of the second hand wheel 24 described later is recorded in association with the rotational angle of the second hand wheel 24 is stored as one of the control data in a storage unit (pattern data storage unit) 36*a* of ROM 36.

EEPROM 35 is provided with a storage unit (corrected data storage unit) 35*a* for storing an examination timing correction value, and a storage unit (specific data storage unit) 35*b* for storing second hole pattern specific data.

The examination timing correction value is data representing the examination timing displacement corresponding to an assembling error when the minute hand 3 has the assembling error. When the minute hand 3 has no assembling error, the examination timing correction value is set to "0 second". When the assembling error of the minute hand 3 is "+1°", the examination timing is delayed by only the count time (10 seconds) corresponding to "1°" of the minute hand 3, and thus the examination timing correction value is set to "10 seconds". When the assembling error of the minute hand 3 is "−2°", the examination timing is advanced by only the count time (20 seconds) corresponding to "2°" of the minute hand 3, and thus the examination timing correction value is set to "−20 seconds".

In a case where an examination timing displacement occurs due to an assembling error of the minute hand 3, data for specifying a detection pattern of through holes when no positional displacement exists in the second hand 2 which varies in accordance with the above examination timing displacement is the second hole pattern specific data. With respect to the examination timing correction value and the second hole pattern specific data, the values corresponding to the assembling error of the minute hand 3 are determined in a setting process before shipping from a factory, and written into the storage units 35*a* and 35*b*, respectively.

Figure 3:
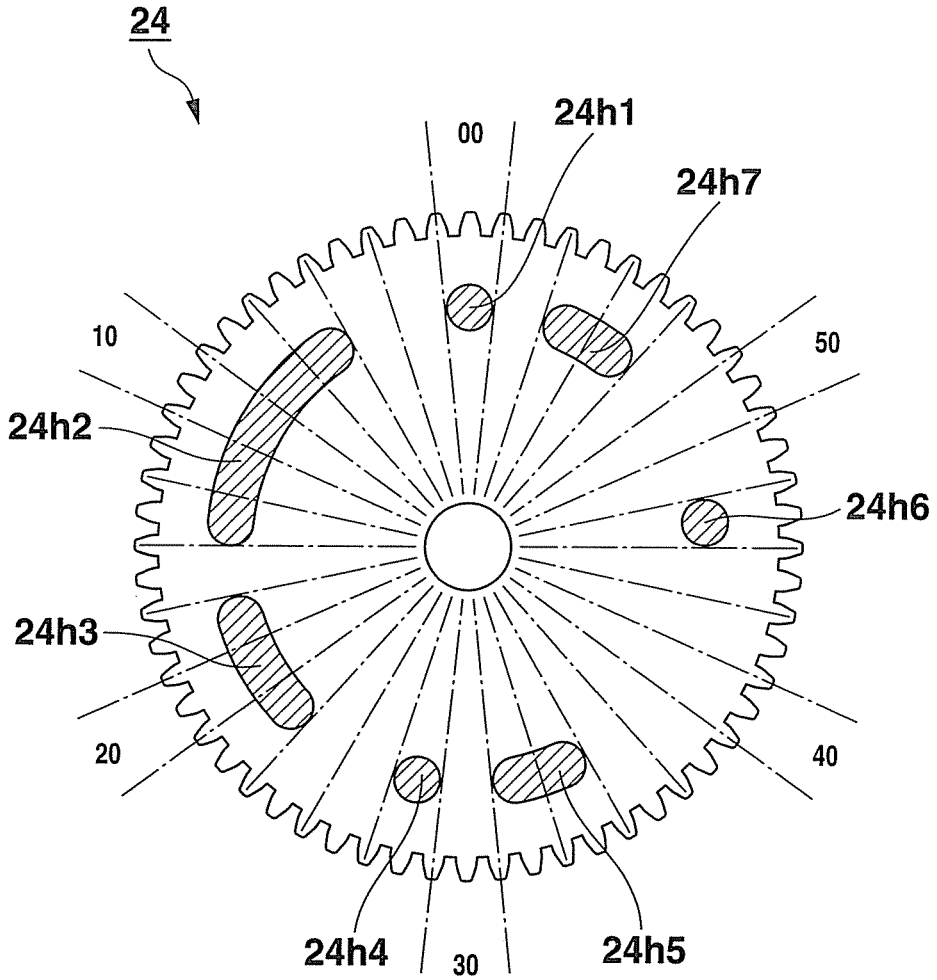
FIG. 3 is a front view showing a second hand wheel.

FIG. 3 is a front view of the second hand wheel 24, and FIG. 4 is a table showing the association relationship between the angle position of every two steps of the second hand wheel 24 and the pattern of the through holes.

A plurality of through holes 24*h*1 to 24*h*7 as a second detection target portion are formed at radial positions overlapped with the detection position P in the second hand wheel 24. The center angle of the second hand wheel 24 are segmented into thirty angular segments every rotational angle (12°) of two steps, and the through holes 24*h*1 to 24*h*7 are formed in predetermined angular segments which satisfy a predetermined conditions.

Here, the predetermined condition contains a first condition under which a through hole necessarily exists in an angular segment located at the 180° opposite side to an angular segment having no through hole, and a second condition under which all presence-or-absence patterns of through holes in successive five angular segments containing any angular segment set as a start point are made different from one another by changing the start point.

In the second hand wheel 24 of FIG. 3, the first through hole 24*h*1 (one-successive portion) is formed in the angular segment of "00" step, the second through hole 24*h*2 (five-successive portions) is formed in the angular segments of the "06" to "14" steps, the third through hole 24*h*3 (three-successive portions) is formed in the angular segments of "18" to "22" steps, the fourth through hole 24*h*4 (one-successive portion) is formed in the angular segment of "28" step, the fifth through hole 24*h*5 (two-successive portions) is formed in the angular segments of "32" to "34" steps, the sixth through hole 24*h*6 (one-successive portion) is formed in the angular segment of "46" step, and the seventh through hole 24*h*7 (two-successive portions) is formed in the angular segments of "54" to "56" steps. The second hand 2 is assembled so as to indicate the reference position (00 second position) on the dial when the first through hole 24*h*1 of the second hand wheel 24 is located at the detection position P.

According to the arrangement of the through holes as described above, any one of the first to seventh through holes 24*h*1 to 24*h*7 exists in an angular segment which is located at the 180° opposite side to an angular segment having no through hole formed therein, and thus the first condition is satisfied.

Furthermore, according to the second hand wheel 24, when the movement of the second hand 2 from 00 second step to 58 second step is viewed at a two-step interval, a state that a through hole is overlapped with the detection position P (referred to as "hole" or "1") and a state that no through hole is overlapped with the detection position P (referred to as "no hole" or "0") appear in an arrangement represented on the line of "hole pattern" in the table of FIG. 4.

According to this hole pattern, as indicated by bracket symbols in the table of FIG. 4, every two steps are set as one segment, and hole patterns each of which has five successive segments (=10 steps) with any step being set as a head are set to have different values from one another by changing the step position of the head. For example, a five successive hole pattern containing 00 second step as the head thereof is "10011", a five successive hole pattern containing 10 second step as the head is "11101", and a five successive hole pattern containing 2 second step as the head is "00111". By changing the head position as described above, all the five successive hole patterns have different arrangement values. That is, the second condition is satisfied.

Furthermore, a section containing five successive no-hole "0" segments occurs in the hole patterns as described above (the position from 36 seconds to 44 seconds in the example of FIGS. 3 and 4). The assembling position of the second hand 2 is set so that the above section is not coincident with a five successive section containing 00 second step, 10 second step, 20 second step, 30 second step, 40 second step or 50 second step as the start point.

Figure 5:
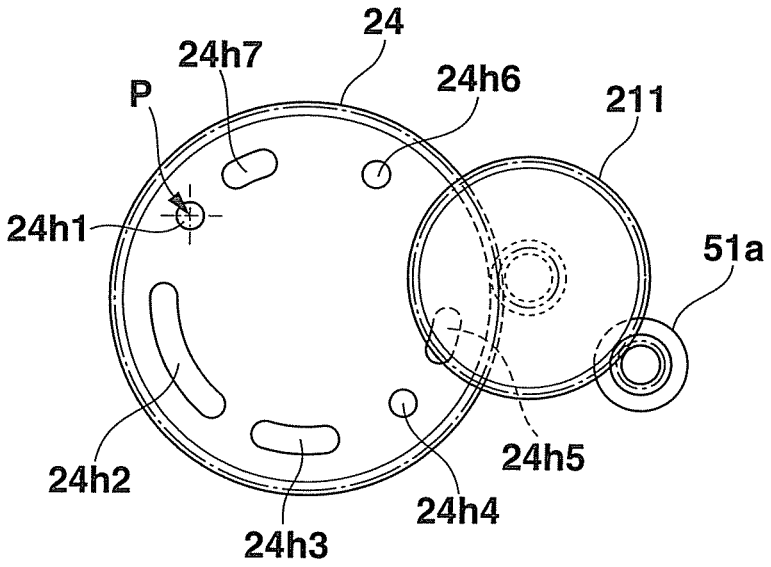
FIG. 5 is a front view showing a wheel train mechanism for rotating the second hand.
Figure 6:
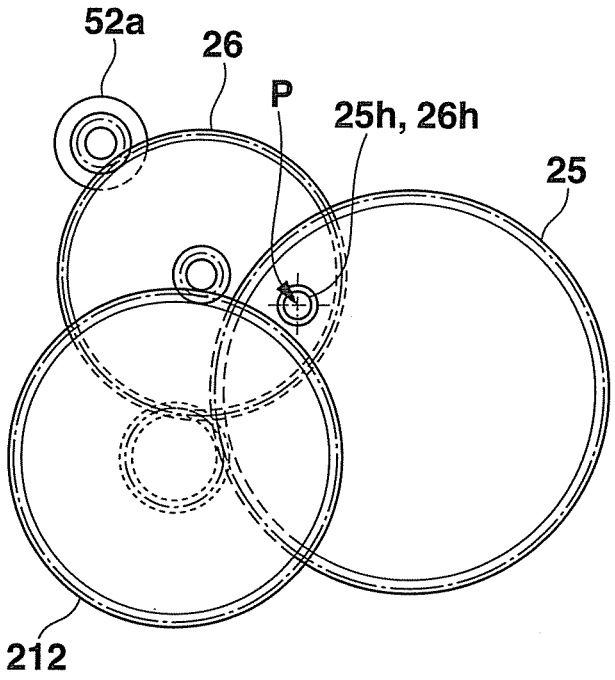
FIG. 6 is a front view showing a wheel train mechanism for rotating a minute hand.
Figure 7:
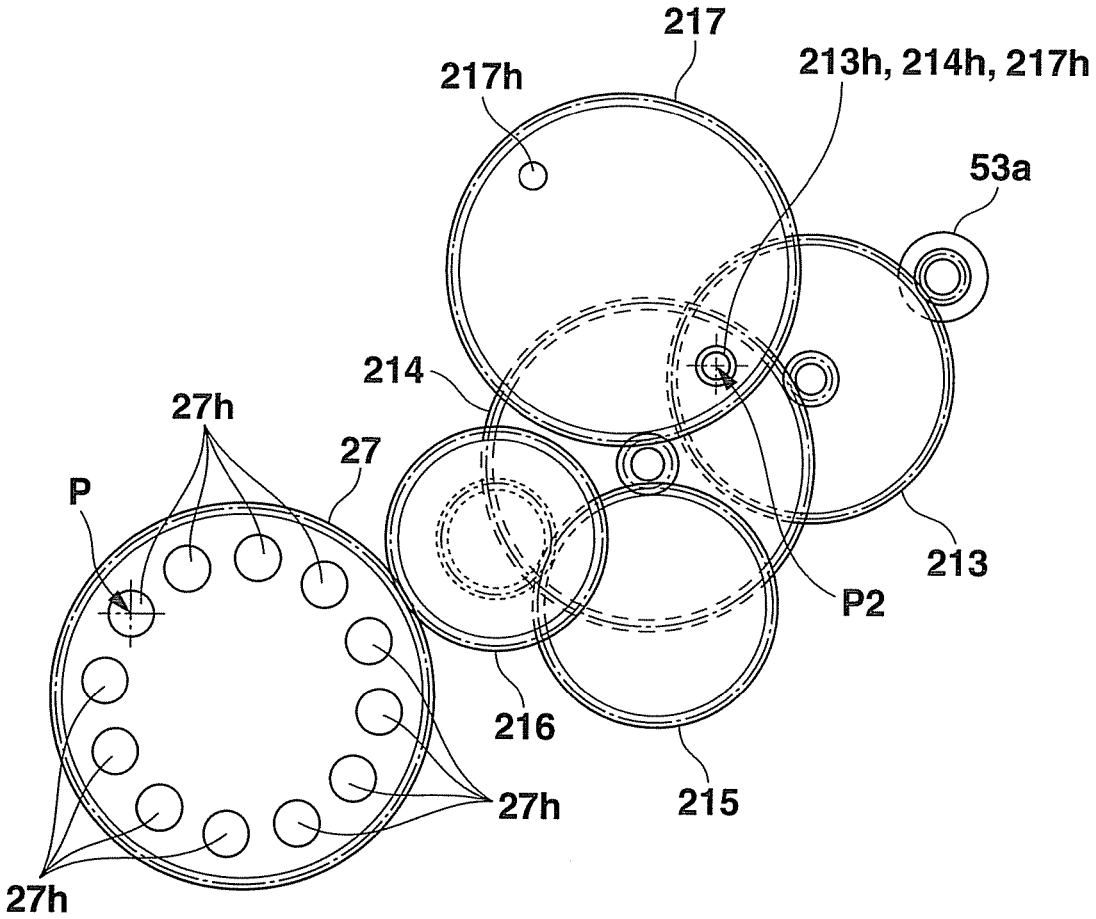
FIG. 7 is a front view showing a wheel train mechanism for rotating a hour hand.

FIGS. 5 to 7 are front views showing a wheel train mechanism for rotating the second hand, the minute hand and the hour hand. Teeth formed in each wheel gear are omitted from illustrations of these figures.

As shown in FIG. 5, the second hand wheel 24 is linked to the rotor 51*a* of the first motor 51 through a fifth wheel 211, and it is rotated every 6° every time the rotor 51*a* rotates by one step (180°). Under normal hand driving operation, the first motor 51 is driven by one step for one second, whereby the second hand 2 and the second hand wheel 24 rotates one round in 60 seconds.

As shown in FIG. 6, the minute hand wheel 25 is linked to the rotor 52*a* of the second motor 52 through the intermediate wheel 26 and a second wheel 212. The intermediate wheel 26 is rotated every 30° and the minute hand wheel 25 is rotated every 1° every time the rotor 52*a* rotates by one step (180°). Under normal hand driving operation, the second motor 52 is driven by one step for 10 seconds, whereby the minute hand 3 and the minute hand wheel 25 rotate one round in 60 minutes.

As shown in FIG. 2, the minute hand wheel 25 is designed to rotate about the same rotational shaft as the second hand wheel 24, and one through hole 25*h* as a first detection target portion is formed at a radial position overlapped with the detection position P. The intermediate wheel 26 is disposed to be partially overlapped with the detection position P, and one through hole 26*h* as a third detection target portion is formed at a radial position overlapped with the detection position P in the intermediate wheel 26.

The through hole 25*h* of the minute hand wheel 25 and the through hole 26*h* of the intermediate wheel 26 are assembled to be overlapped with each other at the detection position P by a predetermined step (step of FIG. 6) of the minute hand wheel 25. The minute hand wheel 25 is rotated by only 1° every one-step driving of the second motor 52, however, the intermediate wheel 26 is rotated by 30° every one-step driving of the second motor 52. Therefore, at the timing before and after one step in FIG. 6, the through hole 26*h* of the intermediate wheel 26 is relatively greatly displaced from the detection position P, and the through hole 25*h* at the detection position P is closed (see FIG. 11)

The minute hand 3 is assembled to indicate a specified time (55 minute 00 second) on the dial at a step position at which the through holes 25*h* and 26*h* of the minute hand wheel 25 and the intermediate wheel 26 are overlapped with each other at the detection position P. However, there may occur a case where the minute hand 3 is assembled with an assembling error of about ±3°. The assembling error of 1° of the minute hand 3 corresponds to the displacement of 10 seconds as the minute hand scale value on the dial.

As shown in FIG. 7, the hour hand wheel 27 is linked to the rotor 53*a* of the third motor 53 through the three intermediate wheels 213, 215 and 216 and the third wheel 214, and it is rotated every 1° every time the rotor 53*a* rotates by one step (180°). Under normal hand driving operation, the third motor 53 rotates by one step every two minutes, whereby the hour hand 4 goes a round in 12 hours.

As shown in FIG. 2, the hour wheel 27 is designed to rotate about the same rotational axis as the second hand wheel 24 and the minute hand wheel 25, and twelve through holes 27*h* are formed at a radial position overlapped with the detection position P in the hour hand wheel 27 so as to be arranged at regular intervals in the circumferential direction. The hour hand 4 and the hour hand wheel 27 are assembled in proper positional relationship, whereby one through hole 27*h* is overlapped with the detection position P when the hour hand 4 indicates a specified time (hh hour 55 minute) of each hour as the hour hand scale on the dial. The hour hand wheel 27 is designed to rotate every 1° per two minutes, and thus the through hole 27*h* is set to be overlapped with the detection position P through the period of about 10 minutes before and after the specified time.

Furthermore, a detection wheel 217 for detecting the position of the hour hand 4 is linked to the wheel train mechanism of the hour hand 4, and through holes 217*h*, 213*h*, 214*h* are formed in the detection wheel 217, the intermediate wheel 213 and the third wheel 214, respectively. The through holes 217*h*, 213*h*, 214*h* are set to be overlapped with the second detection position P2 at the specified time for detecting the hour hand (for example, 11 hour 55 minute, 23 hour 55 minute).

Next, the operation of the thus constructed electronic timepiece 1 will be described.

[Time Display Processing]

In the electronic timepiece 1 of this embodiment, CPU 10 normally outputs a signal for driving the first motor 51 by one step at a time interval of one second on the basis of a predetermined period signal from the frequency dividing circuit 39, outputs a signal for driving the second motor 52 by one step at a time interval of ten seconds, and outputs a signal for driving the third motor 53 by one step at a time interval of two minutes, whereby each of the hands 2 to 4 is driven with time lapse and the time is displayed.

In the electronic timepiece 1, for example when strong magnetic field or strong impact is applied during the time display processing as described above, there occurs such a phenomenon that the corresponding motor of the first to third motors 51 to 53 is not rotated in spite of output of the signal for driving the motor from CPU 10, or any one of the first to third motors 51 to 53 is rotated in spite of output of no signal for driving the motor from CPU 10. In this case, a displacement occurs between the time counted by CPU 10 or the hand position of each of the hands 2 to 4 counted by CPU 10 and the hand position of each of the actual hands 2 to 4. Therefore, according to the following hand position detecting and correcting processing, the positional displacement of each of the hands 2 to 4 is checked, and also it is corrected when the positional displacement occurs.

[Hand Position Detecting and Correcting Processing]

Figure 8:
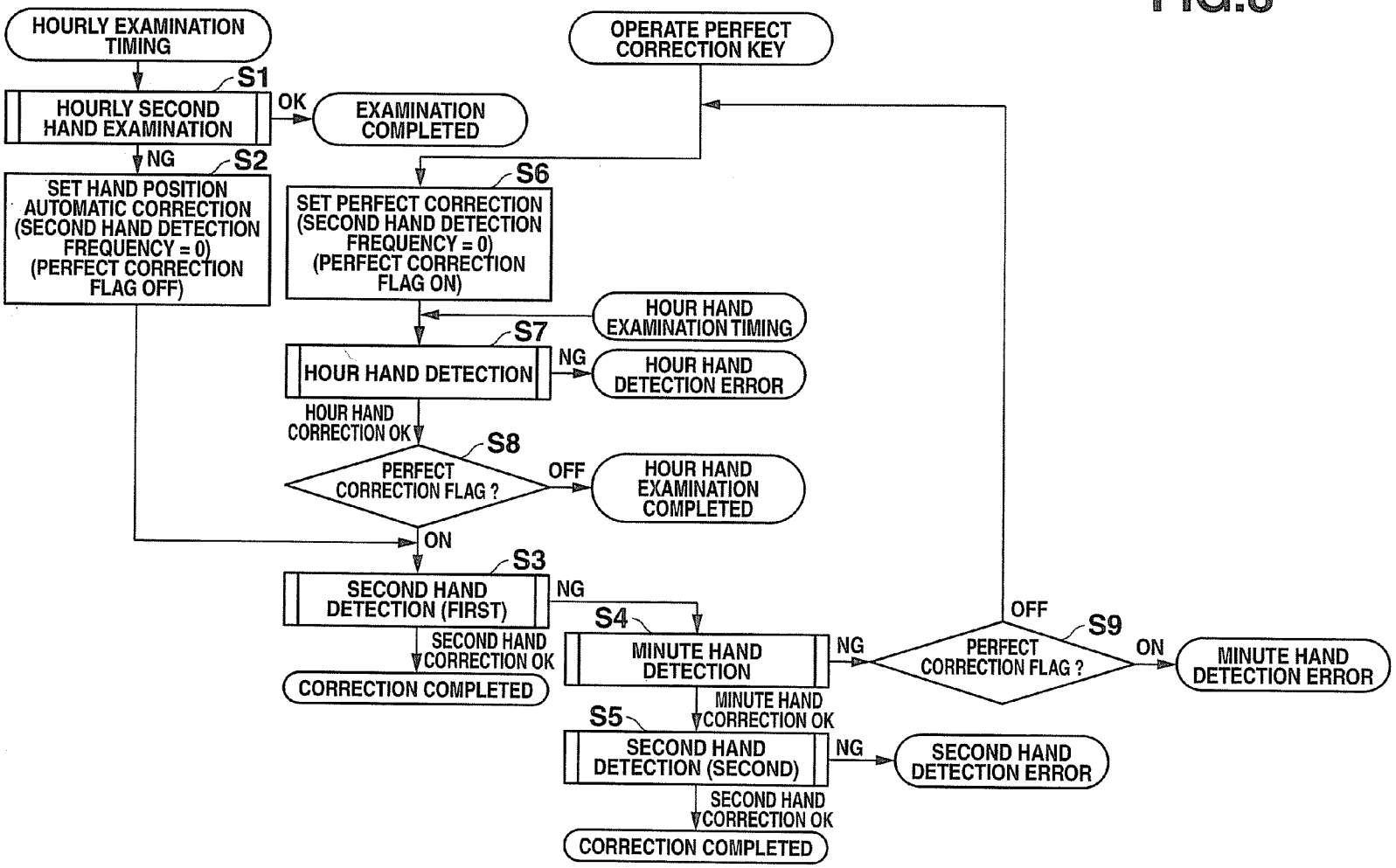
FIG. 8 is a flowchart showing the flow of hand position detection correcting processing executed by CPU.

FIG. 8 is a flowchart showing the flow of the hand position detecting and correcting processing executed by CPU 10.

This hand position detecting and correcting processing is started at the hourly examination timing at which the through hole 25*h* of the minute hand wheel 25 is overlapped with the detection position P, at the hour hand examination timing (11 hour 55 minute and 23 hour 55 minute) at which the through hole 217*h* of the detection wheel (FIG. 7) 217 is overlapped with the second detection position P2, or when a perfect correction key operation is executed from the external through an operating button (not shown). This processing is started from the step S1 in the case of the hourly examination timing, started from the step S7 in the case of the hour hand examination timing and started from the step S6 in the case of the perfect correction key operation.

In the hand position detecting and correcting processing, the hourly second hand examination processing (step S1) is the processing for checking whether the second hand 2 or the minute hand 3 are positionally displaced while a normal hand driving operation of displaying the time is performed. Furthermore, the second hand detecting processing (steps S3, S5) is the processing for detecting the position of the second hand 2 and correcting the positional displacement under a situation that the position of the second hand 2 is unclear. The minute hand detecting processing 3 (step S4) is the processing for detecting the position of the minute hand 3 and correcting the positional displacement under a situation that the position of the minute hand 3 is unclear, and the hour hand detecting processing (step S7) is the processing for detecting the position of the hour hand 4 and correcting the positional displacement under a situation that the position of the hour hand 4 is unclear.

Furthermore, in this hand position detecting and correcting processing, a perfect correcting flag representing whether perfect correction (the position detection of all the hands 2 to 4 and the correction of the positional displacement) is being executed or not, and a variable representing the frequency of the second hand detection processing are set in a predetermined area of RAM 37, and condition branching is appropriately performed in accordance with these values.

First, the flow of the processing at the hourly examination timing will be described. The hourly examination timing is set to a time which is shifted from the specified time (every hour 55 minute 00 second) by only the examination timing correction value stored in the storage unit 35*a* of EEPROM 35. For example, when the minute hand 3 has no assembling error and the examination timing correction value is set to "0 second", the specified time described above is equal to the hourly examination timing. When the assembling error of the minute hand 3 is "−1°" and the examination timing correction value is set to "−10 seconds", "every hour 54 minute 50 second" is equal to the hourly examination timing. Furthermore, when the assembling error of the minute hand 3 is equal to "+2°" and the examination timing correction value is set to "+20 seconds", every hour 55 minute 20 second is equal to the hourly examination timing. When no positional displacement (not the assembling error, but the positional displacement caused by external magnetic field or external impact) occurs in the minute hand 3, the hourly examination timing is the timing at which the through holes 25*h*, 26*h* of the minute hand wheel 25 and the intermediate wheel 26 are overlapped with each other at the detection position P.

In initialization processing or the like at the power-on time, CPU 10 sets this hourly examination timing to a timer, whereby the hand position detecting and correcting processing is started from the step S1 when the hourly examination timing comes. First, the overall flow of the processing will be described.

When there is no positional displacement in the second hand 2 and the minute hand 3 and the hourly examination timing comes, the positional displacement is examined in the hourly second hand examination (step S1) while the normal hand driving operation is executed, and the examination is completed (the hand position detecting and correcting processing is finished) on the basis of determination of "OK" representing no positional displacement.

When there is a positional displacement in only the second hand 2 and the hourly examination timing comes, "NG" determination representing existence of positional displacement is made in the hourly second hand examination (step S1). Therefore, subsequently, hand position automatic correction is set (a perfect correction flag is set to OFF and a second hand detection frequency is set to "0") in step S2, and the first second hand detection processing (step S3) is first executed. When only the second hand 2 has a positional displacement, the position detection of the second hand 2 and the correction can be performed at this time, and thus the correction is completed (the hand position detecting and correcting processing is finished) on the basis of the result of the second hand correction "OK".

Furthermore, when the minute hand 3 or both the minute hand 3 and the second hand 2 are positionally displaced and the hourly examination timing comes, the detection position P is set to be closed by the minute hand wheel 25 and the intermediate wheel 26. Therefore, "NG" is determined in the hourly second hand examination (step S1), and after the hand position automatic correction is set (step S2), "NG" is also determined in the 1st second hand detection processing (step S3). Therefore, subsequently, the minute hand detection processing (step S4) is executed, and after the position detection of the minute hand 3 and the correction of the positional displacement are performed, the second hand detection processing (step S5) is executed and the correction is completed (the hand position detecting and correcting processing is finished). When "NG" is determined in the 2nd second hand detection processing (step S5), it is determined that some error occurs and thus the processing is error-finished (second hand detection error).

Furthermore, when the hourly examination timing comes under the state that the hourly hand 4 has a specific positional displacement (for example, all the twelve through holes 27*h* of the hour hand wheel 27 are displaced from the detection position P), the hour hand wheel 27 closes the detection position P and "NG" is determined with respect to the position detection of the second hand 2 and the minute hand 3. Therefore, after the processing goes to the steps S1, S2 and S3, "NG" is also determined in the minute hand detection processing (step S4). Accordingly, after it is subsequently checked on the basis of the perfect correction flag whether the detection processing of the hour hand 4 has been finished (step S9), the perfect correction setting (the perfect correction flag is set to ON and the second hand detection frequency is set to "0") is executed in step S6 to perform the perfect correction, and then the processing goes to step S7. In the hour hand detection processing (step S7), the position detection of the hour hand 4 and the correction of the positional displacement are performed, whereby the specific positional displacement of the hour hand 4 is corrected. Thereafter, necessary processing out of the 1st or 2nd second hand detection processing (steps S3, S5) and the minute hand detection processing (step S4) is executed, whereby when there is a positional displacement with respect to the second hand 2 and the minute hand 3, the correction is executed and thus the correction is completed (hand position detecting and correcting processing is finished). Next, the flow of the processing at the hour hand examination timing will be described. When the hour hand examination timing comes and thus the hand position detecting and correcting processing of FIG. 8 is started, the position detection of the hour hand 4 is performed in the hour hand detection processing (step S7). At this time, when there is a positional displacement, the positional displacement is corrected. In the determination processing of the step S8, the processing goes to "OFF" side to complete the hour hand examination (the hand position detecting and correcting processing is finished). The hand detection and the correction can be independently performed in the hour hand 4 even when the other hands 2, 3 are located at any positions, and thus when "NG" is determined in the hour hand detection processing (step S7), the processing is error-finished (the hour hand detection error) because it is determined that some error occurs.

Next, the flow of the processing when the perfect correcting key is operated will be described. When the hand position detecting and correcting processing is started by the perfect correcting key operation, the setting for perfect correction (step S6) is performed, and then the hour hand detection processing (step S7) is performed, whereby the hand position detection and the correction of the hour hand 4 are first performed, the necessary processing out of the 1st and 2nd second hand detection processing (steps S3, S5) and the minute hand detection processing (step S4) is executed, and when the second hand 2 and the minute hand 3 have positional displacements, they are corrected. Then, the correction is completed.

When "NG" is determined in the processing of the steps S7, S4, S5, it is determined that some error occurs and thus the respective processing is error-finished.

Through the hand position detecting and correcting processing as described above, the presence or absence of the positional displacement of the second hand 2 and the minute hand 3 is checked while the normal hand driving operation is executed every hourly examination timing, and when each hand has a positional displacement, the position detection and the correction of the hand having the positional displacement are performed. Furthermore, the check and correction of the positional displacement of the hour hand 4 are performed every hour hand examination timing while the normal hand driving operation is executed, and further the user operates the perfect correction key. Accordingly, the hand position detection of each of the hands 2 to 4 and the correction of each hand when it has a positional displacement are performed at any timing.

Subsequently, the processing of each step of the hand position detecting and correcting processing will be described in detail.

[Hourly Second Hand Examination Processing]

Figure 9:
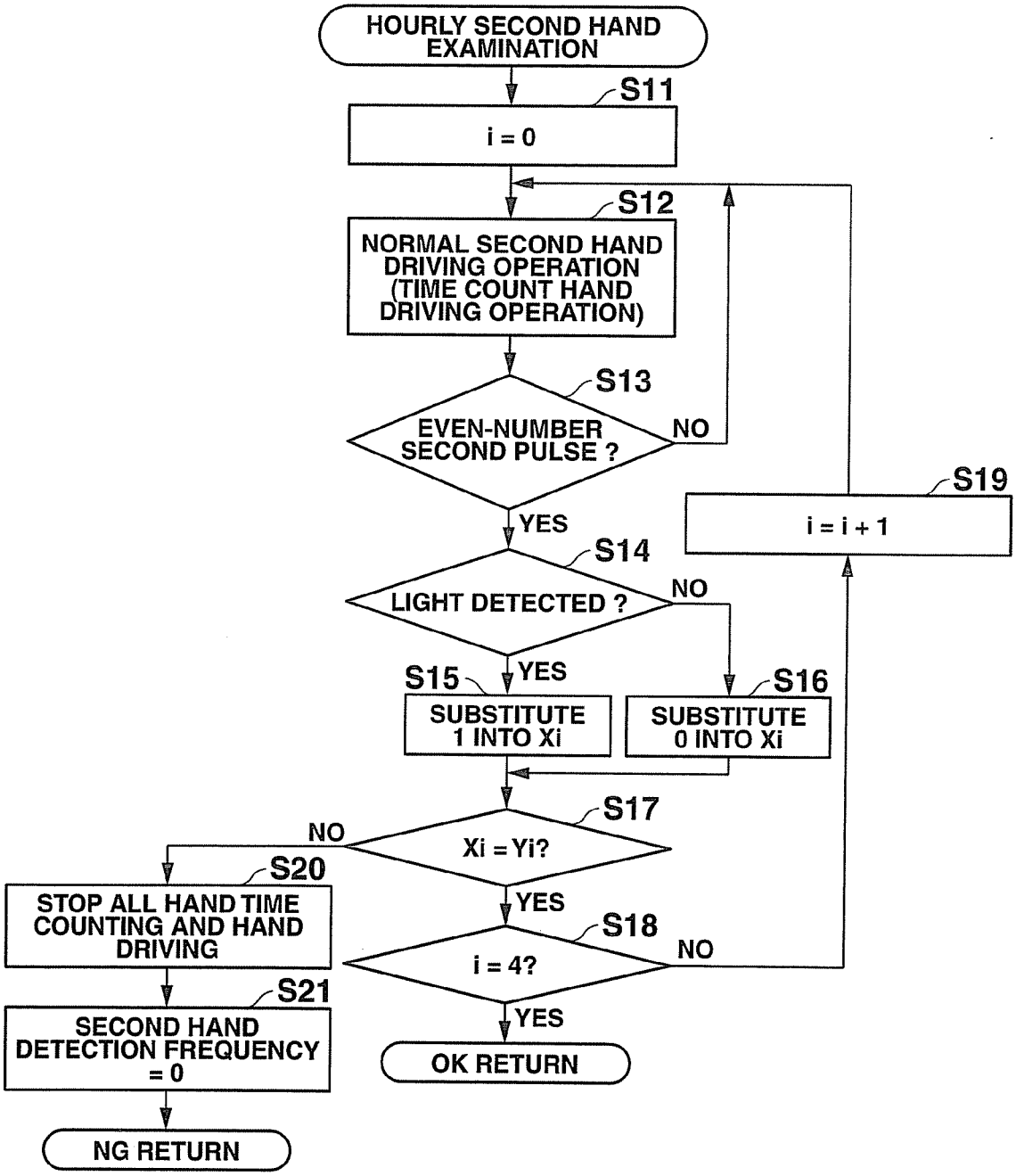
FIG. 9 is a flowchart showing a control procedure of the processing of hourly second hand examination executed in step S1 of FIG. 8.

FIG. 9 is a flowchart showing the hourly second hand examination executed in step S1 of FIG. 8. FIG. 10 is a table showing the association relationship of a shift amount of the minute hand 3 for eliminating an assembling error of the minute hand 3 (called as "hand shift amount (unit is ° or step)"), a hourly examination timing and a second hole pattern of a comparative target.

The hourly second hand examination is the processing for performing five-times detection processing, that is, detection processing for determining through the first detector 31 whether the through holes are set to be overlapped with each other at the detection position P every time the second hand 2 is moved from a predetermined hourly examination timing by two steps under normal hand driving operation, thereby judging the presence or absence of the positional displacement of the second hand 2 or the minute hand 3.

The detection processing is executed every movement of two steps for the following reason. The first motor 51 is a stepping motor having a bipolar rotor and a bipolar stator. The rotor rotates from 0° to 180° by supplying a plus driving pulse, and also the rotor rotates from 180° to 360° by supplying a minus driving pulse. By alternately supplying the plus driving pulse and the minus driving pulse, the rotor rotates in one direction every half-turn. Therefore, even when the minute hand 3 or the hour hand 4 suffers strong magnetic field or strong impact and thus is positionally displaced, the positional displacement afterwards does not remain at an odd number of steps, but the positional displacement necessarily remains at an even number of steps. Therefore, the detection processing is executed every movement of two steps.

As described above, the hourly examination timing is set to the timing at which the through holes 25*h*, 26*h* of the minute wheel 25 and the intermediate wheel 26 are overlapped at the detection position P when no positional displacement (no positional displacement caused by the strong magnetic field or the like) occurs in the minute hand 3 as described above. This timing is equal to the count timing of every hour 55 minute 00 second when there is no assembling error of the minute hand 3 (in the case of the range of ±0.5°). On the other hand, as shown in the table of FIG. 10, when the hand shift amount for eliminating the assembling error of the minute hand 3 is from "+6°" to "−5°", this timing is set to each timing which is displaced from every hour 54 minute 00 second to every hour 55 minute 50 second every 10 seconds in accordance with the hand shift amount.

Figure 11:
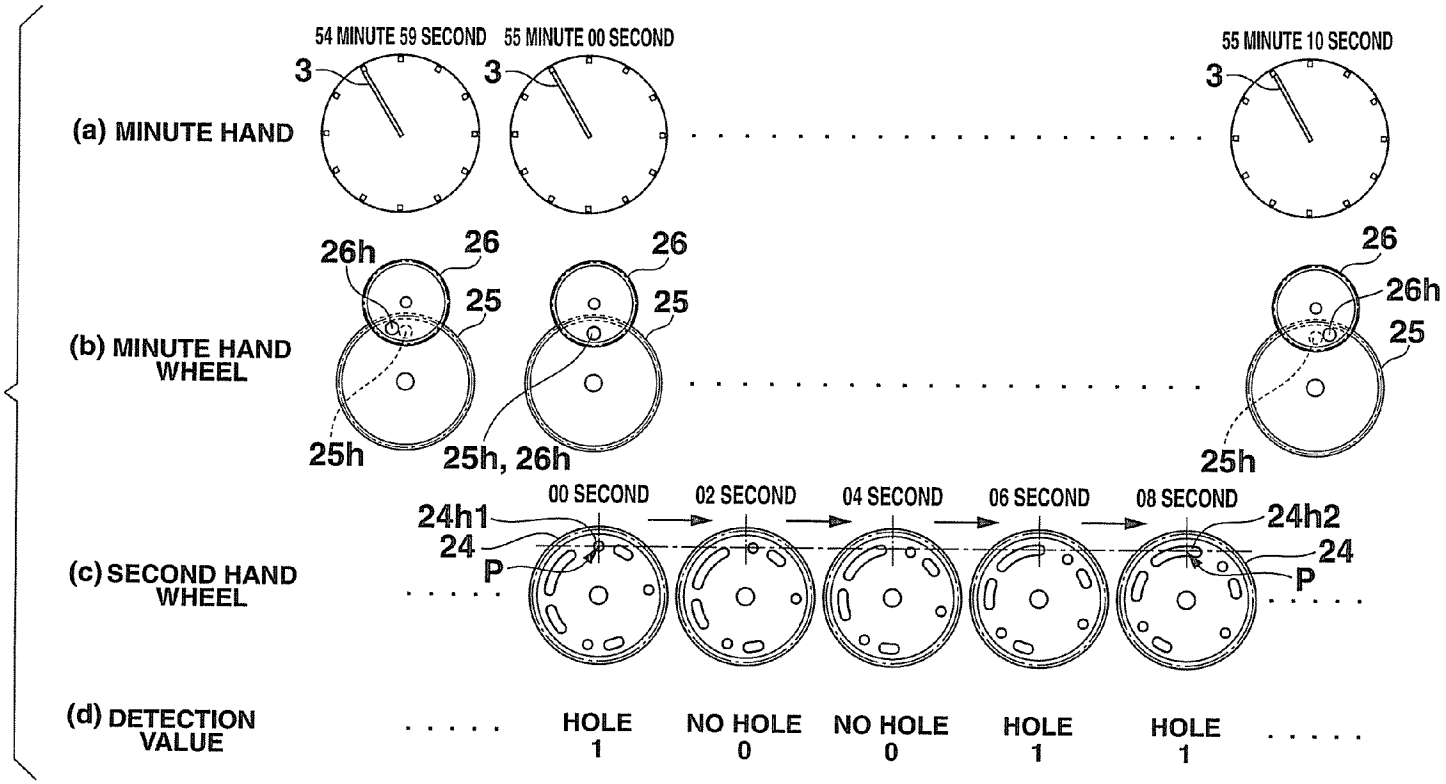
FIG. 11 is a diagram showing a timepiece state for a fixed time period before and after the hourly examination timing when the hand shift amount is equal to "0°".
Figure 12:
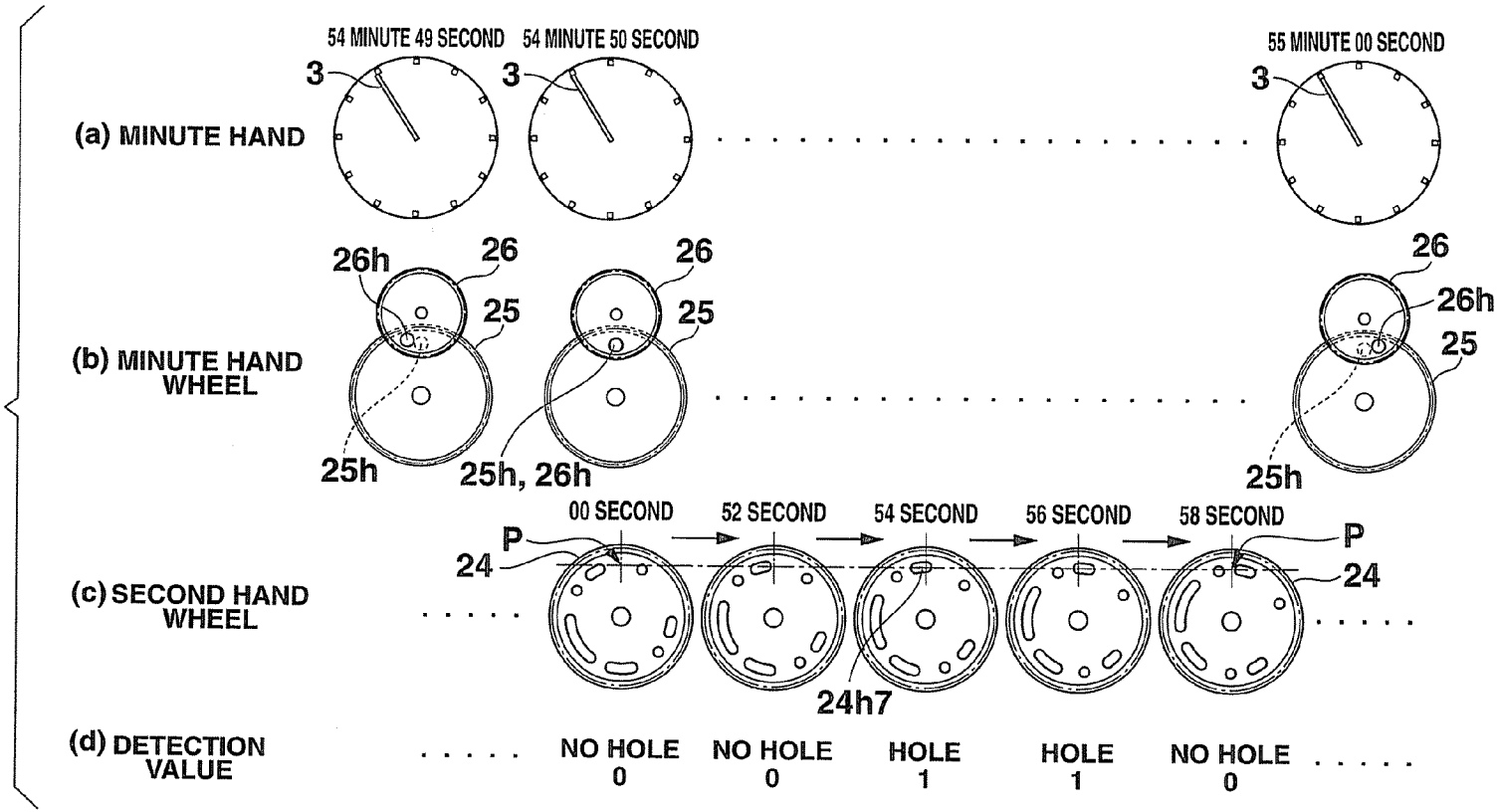
FIG. 12 is a diagram showing a timepiece state for a fixed time period before and after the hourly examination timing when the hand shift amount is equal to "+1°".
Figure 13:
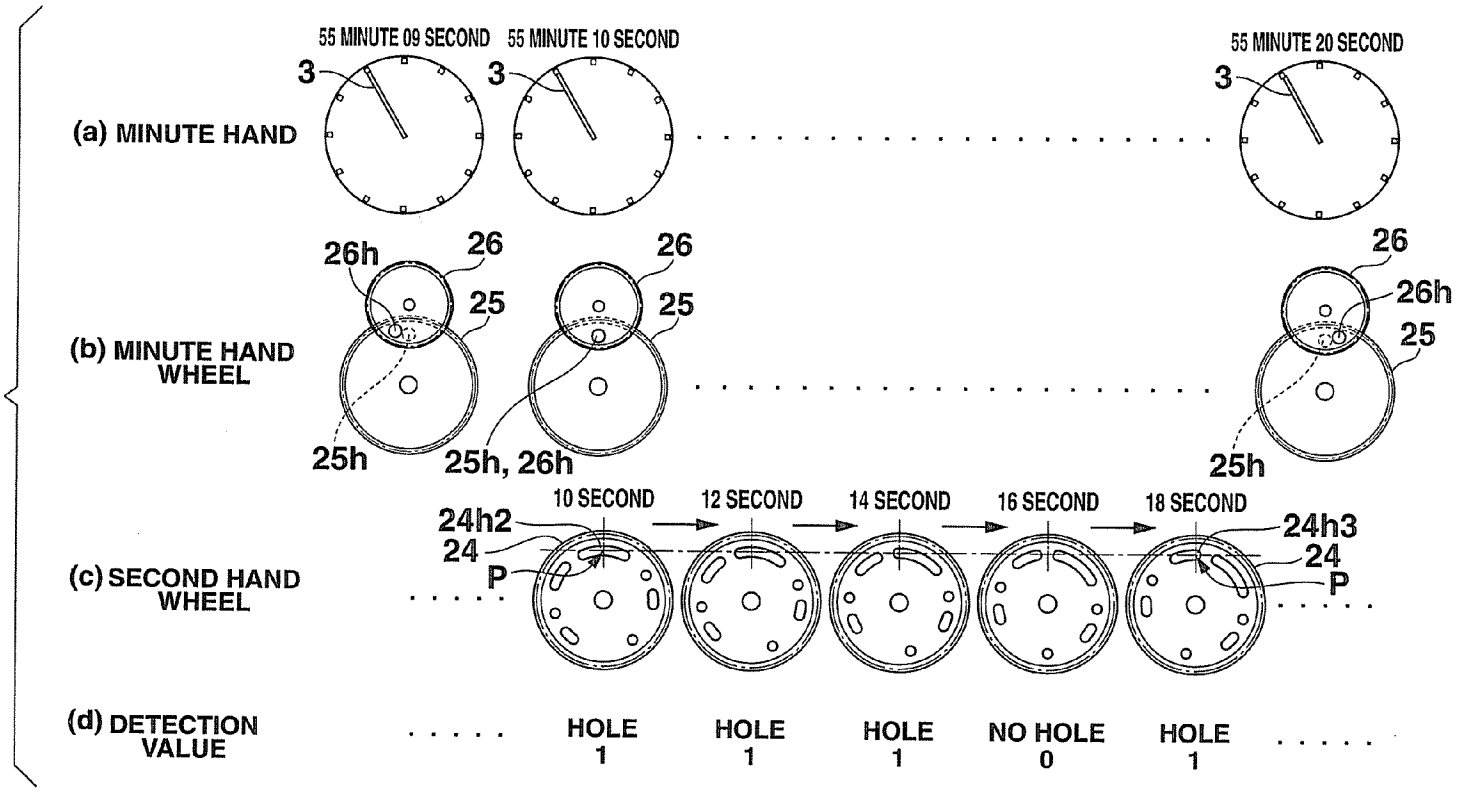
FIG. 13 is a diagram showing a timepiece state for a fixed time period before and after the hourly examination timing when the hand shift amount is equal to "−1°".

FIGS. 11 to 13 are diagrams showing states during fixed time periods before and after the hourly examination timing. FIG. 11 shows the state when the hand shift amount for eliminating the assembling error of the minute hand 3 is equal to "0°", FIG. 12 shows the state when the hand shift amount is equal to "+1°", and FIG. 13 shows the state when the hand shift amount is equal to "−1°".

The position at which the second hand 2 should be located at the hourly examination timing corresponds to the position on the dial which represents the second digit value of the hourly examination timing. Accordingly, during the period when the second hand 2 is moved from the hourly examination timing by 10 steps, the angle range of the second hand wheel 24 overlapped with the detection position P varies in accordance with the hand shift amount for eliminating the assembling error of the minute hand 3.

For example, as shown on the line of "hand shift amount "0"" of FIG. 10 and the diagram of FIG. 11, when the hand shift amount of the minute hand 3 is "0°", the examination timing at which the through holes 25*h*, 26*h* are overlapped with each other at the detection position P is "55 minute 00 second", and then the second hand 2 moves over the range from the position of "00" second on the dial to the position of "08" second for subsequent eight seconds. Therefore, the angular range in which the second hand wheel 2 passes over the detection position P corresponds to the range of "00" to "08" steps of FIG. 3, and the first detector 31 is actuated five times every two step to obtain "10011" as a result.

Furthermore, as shown on the line of "hand shift amount "1"" of FIG. 10 and in the diagram of FIG. 12, when the hand shift amount for eliminating the assembling error of the minute hand 3 is "+1°", the examination timing at which the through holes 25*h*, 26*h* are overlapped with each other at the detection position P is "54 minute 50 second", and then the second hand 2 moves in the range from the position of "50" second on the dial to the position of "58" second for subsequent eight seconds. Therefore, the angular range in which the second hand wheel 24 passes over the detection position corresponds to the range of "50" to "58" steps of FIG. 3, and the first detector 31 is actuated five times every two steps to obtain "00110" as a result.

Furthermore, as shown on the line of "hand shift amount "−1"" FIG. 10 and in the diagram of FIG. 13, when the hand shift amount for eliminating the assembling error of the minute hand 3 is "−1°", the examination timing at which the through holes 25*h*, 26*h* are overlapped with each other at the detection position P is "55 minute 10 second", and then the second hand 2 moves in the range from the position of "10" second to the position of "18" second on the dial for subsequent eight seconds. Therefore, the angular range in which the second hand wheel 24 passes over the detection position P corresponds to the range of "10" to "18" steps of FIG. 3, and the first detector 31 is actuated five times every two steps to obtain "11101" as a result.

In the table of FIG. 10, the values of the detection results of the five times described above are represented in the column of "$Y_0$ to $Y_4$". The pattern of these detection results is represented by indexes "A" to "F" in the column of "second hole pattern".

Here, the second hole pattern specific data stored in the storage unit 35*b* of EEPROM 35 described above will be additionally described. The second hole pattern specific data is described as data for specifying the detection pattern of the through holes which varies in accordance with the assembling error of the minute hand 3. The values of "$Y_0$ to $Y_4$" of FIG. 10 correspond to the detection pattern of the through holes described above, and the index values of "A" to "F" represented on the column of "second hole pattern" of FIG. 10 correspond to the second hole pattern specific data.

The second hole pattern data table representing the formation pattern of the through holes 24*h*1 to 24*h*7 of the second hand wheel 24 in association with the rotational angle is stored in the storage unit 36*a* of ROM 36. Therefore, on the basis of the second hole pattern specific data, CPU 10 can read out the values of the corresponding range from the second hole pattern data table, and specify the values of the second hole pattern "$Y_0$ to $Y_4$".

When the processing shifts to the hourly second hand examination (FIG. 9), CPU 10 first substitutes an initial value "0" into a variable i representing the frequency of the five-time detection processing (step S11), and waits until the value of the second digit is moved up through the time count processing. When it is moved up, the first motor 51 is driven by one step to drive the second hand 2 by one step (normal second hand driving operation: step S12). Furthermore, it is judged whether the hand driving pulse of the step S12 is a hand driving pulse of an even-number second or an odd-number second (step S13). In the case of the hand driving pulse of the odd-number second, the processing returns to the step S12, and in the case of the hand driving pulse of the even-number second, the processing shifts to the next step.

When the processing shifts to the next step, CPU 10 actuates the first detector 31 to judge whether light of the light emitting unit 311 is detected by the photosensor 312 (step S14). The first detection controller is constructed by the processing for executing the step S14 at five times. Here, light is detected when any one of the through holes 24*h*1 to 24*h*7 of the second hand wheel 24 and each of the through holes 25*h* to 27*h* of the minute hand wheel 25, the intermediate wheel 26 and the hour hand wheel 27 are overlapped at the detection position P, however, no light is detected when any one of these through holes deviates from the detection position P and thus the through holes are closed. Therefore, in accordance with the determination result of this step S14, the value representing the detection result ("1" for light detection and "0" for no light detection) is substituted into one of variables $X_0$ to $X_4$ which corresponds to the present detection frequency i (step S15 or S16).

When the value of the detection result is substituted, the value of the variable $X_i$ is compared with the value $Y_i$ corresponding to the present detection frequency i out of the second hole pattern to be detected (step S17). The values $Y_0$ to $Y_4$ of the second hole pattern are specified by referring to the second hole pattern data table stored in the storage unit 36*a* of ROM 36 on the basis of the second hole pattern specific data read out from the storage unit 35*b* of EEPROM 35 by CPU 10 in the initialization processing at the power-on time, for example, and stored in a predetermined area of RAM 37.

When they are coincident with each other as a comparison result of the step S17, the frequency of the detection processing is checked (step S18), and when the frequency has not reached five times, the frequency value (variable i) is updated and then the processing returns to step S12 to execute the detection processing at five times.

On the other hand, when they are not coincident with each other, it is determined that a positional displacement occurs in the hands 2 to 4, time counting and hand driving of each of the hands 2 to 4 are stopped (step S20), "0" is substituted into the variable representing the second hand detection frequency for subsequent processing (step S21), the detection result is set to "NG" and then the hourly second hand examination is finished.

Furthermore, when the detection processing reaches the five-time detection processing as a result of the determination processing of the step S18, it means that the five-time detection results $X_0$ to $X_4$ are coincident with the values $Y_0$ to $Y_4$ of the second hole pattern of the comparative target, and thus the detection result is set to "OK", and the hourly second hand examination is finished. The judging unit is constructed by the processing of the steps S17 and S18.

Through the processing of the hourly second hand examination as described above, even when the minute hand 3 has an assembling error and thus the hourly examination timing is displaced by several tens seconds, the comparative target values $Y_0$ to $Y_4$ of the detection pattern of the through holes are appropriately changed in accordance with the hand shift amount, whereby the presence or absence of the positional displacement of the second hand 2 and the minute hand 3 can be checked without changing the algorithm.

[Second Hand Detection Processing]

Figure 14:
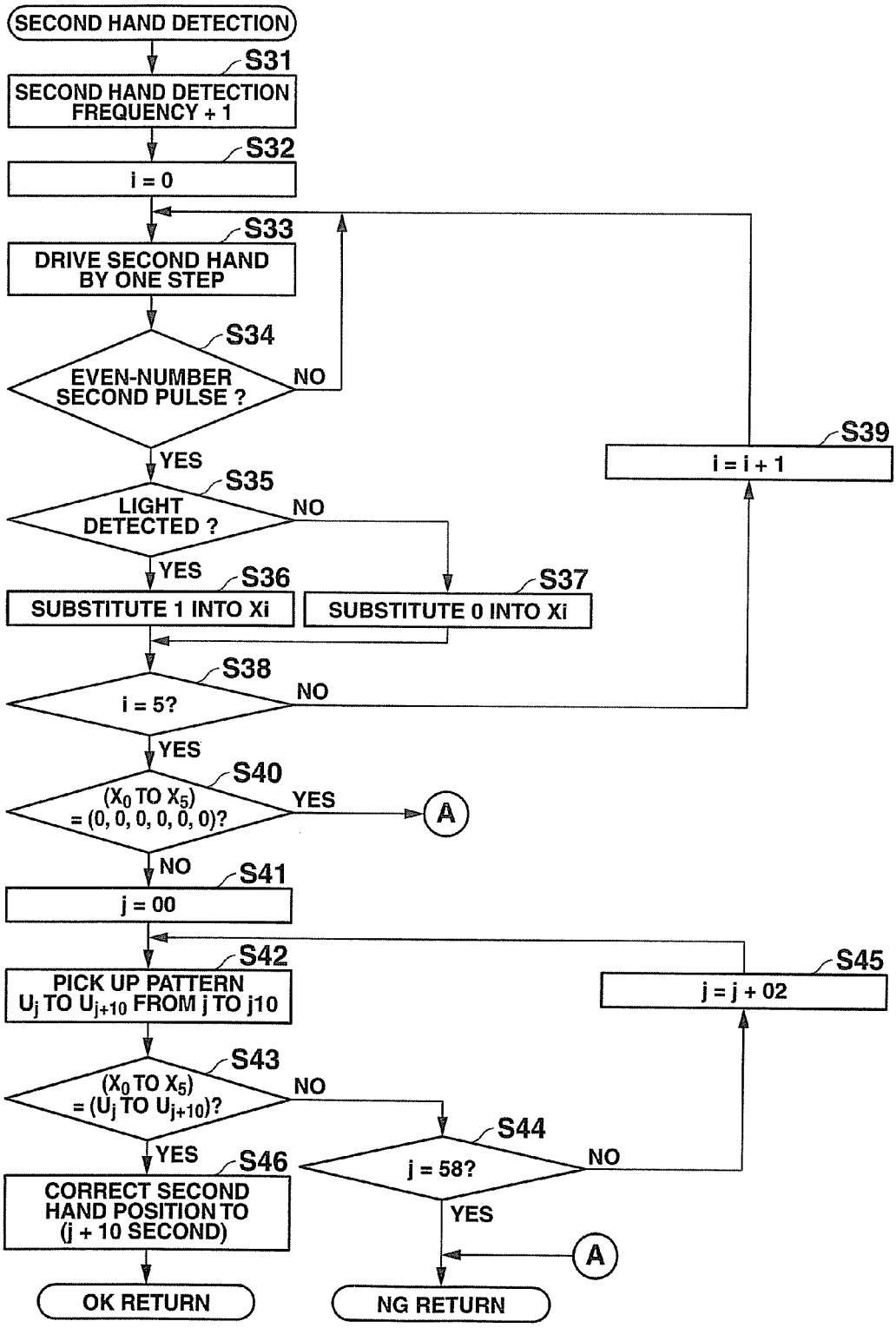
FIG. 14 is a flowchart showing a control procedure of the second hand detection processing executed in steps S3, S5 of FIG. 8.
Figure 15A:
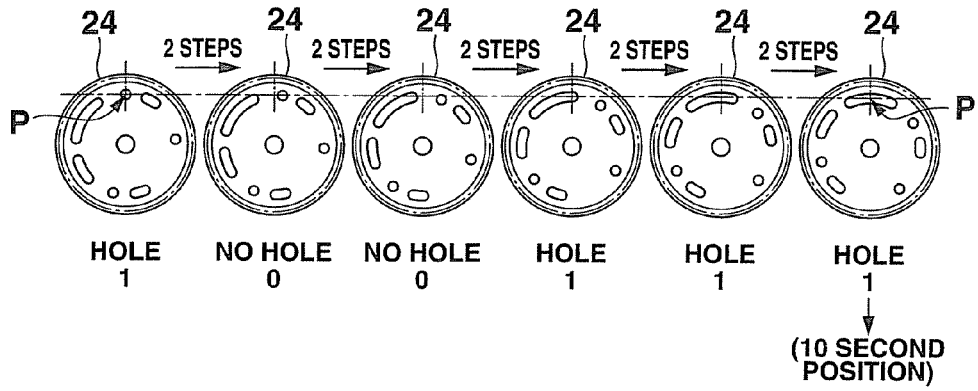
FIGS. 15A to 15C are diagrams showing three specific examples of the second hole pattern detected through the second hand detection processing.
Figure 15B:
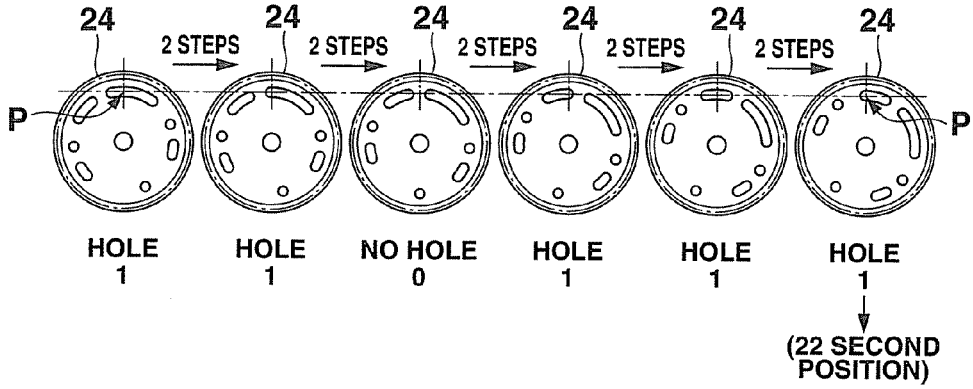
Figure 15C:
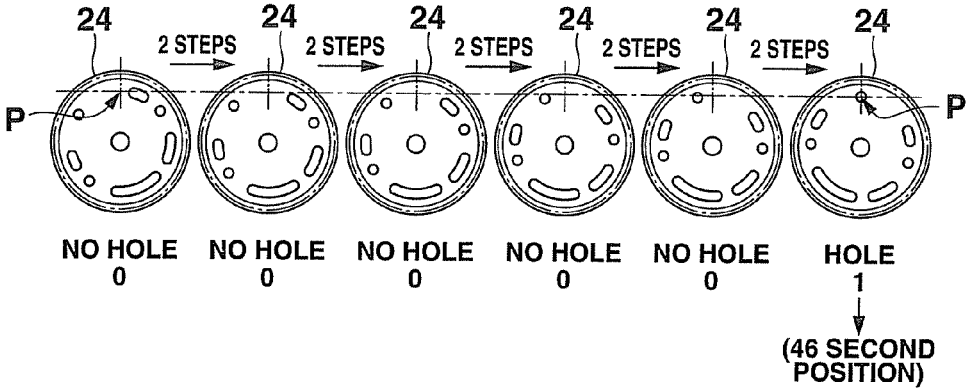

FIG. 14 is a flowchart showing the second hand detection processing executed in steps S3, S5 of FIG. 8. FIGS. 15A to 15C are diagrams showing three specific examples of the second hole pattern detected through the second hand detection processing.

The second hand detection processing performs the position detection of the second hand 2 and the correction of the count value representing the position of the second hand 2 under the situation that the position of the second hand 2 is unclear due to the positional displacement of the hands 2 to 4.

As shown in the table of FIG. 4, the two-step-based hole pattern of the through holes 24*h*1 to 24*h*7 of the second hand wheel 24 has the feature that all hole patterns each comprising five constituent holes are different from one another when the head step position is changed.

Accordingly, in the second hand detection processing, the position detection of the second hand 2 is performed by using the above feature. However, as indicated by the value of the hole pattern of the hand position "36" to "44" steps of the table of FIG. 4, the second hand wheel 24 has one angular range in which "no hole" ("0") is successive at five times with two steps set as a unit. When "no hole" is detected at all times in the five-time detection processing of the first detector 31, it is not discriminated whether a section on the second hand wheel 24 which contains five successive "no hole" sites comes at the detection position P or another gear closes the through holes and thus all "no hole" is determined. Accordingly, in this second hand detection processing, the position detection of the second hand 2 is performed by executing the detection processing at six times with two steps set as a unit.

When the processing shifts to the second hand detection processing (FIG. 14), first the variable representing the second hand detection frequency is updated to "+1" for the condition branch at another site (step S31). Subsequently, the initial value "0" is substituted into the variable i representing the frequency of the through-hole detection processing of the first detector 31 (step S32), and the first motor 51 is actuate to drive the second hand 2 by one step (step S33). Furthermore, it is judged whether the driving is based on the even-number second pulse or not (step S34). When the driving is based on the odd-number second pulse, the hand is further driven by one step (step S33), and then the processing is shifted to the next step.

When the hand is driven by the even-number pulse, the first detector 31 is actuated, and it is judged whether light of the light emitting unit 311 is detected by the photosensor 311 (step S35). This result is substituted into the variable corresponding to the detection frequency i out of the variables $X_0$ to $X_5$ (steps S36, S37). Subsequently, the detection frequency i is checked (step S38), and when the detection frequency does not reach six times (i=5), the variable i is updated to "+1" (step S39) and the processing returns to the step S33. On the other hand, when the detection frequency reaches six times (i=5), the detection results $X_0$ to $X_5$ of the six times of each two-step rotation are obtained, and thus the processing goes to the next step. The second detection controller is constructed by the processing for performing the step S35 at six times.

As indicated in three specific examples of FIGS. 15A to 15C, the detection results $X_0$ to $X_5$ obtained through the detection processing of the six times are made different in accordance with the rotational position of the second hand wheel 24. Furthermore, the angular section having no through hole in the second hand wheel 24 is a five successive section even when it is long. Therefore, as shown in FIG. 15C, when this angular section comes to the portion of the detection position P during the six-time detection processing, there is no case where "no hole" is judged in all the detection processing of the six times.

Accordingly, when the processing shifts to the step S40, it is judged whether the detection results $X_0$ to $X_5$ of the six times is coincident with an arrangement value of "000000" which is impossible as a hole pattern of the second hand wheel 24. When they are coincident with each other, it can be determined that another gear closes the through hole and thus the position detection of the second hand is impossible. Therefore, the detection result is set to "NG" and the second hand detection processing is finished.

On the other hand, when they are not coincident with each other, it is searched through loop processing of step S41 and steps S42 to S45 which part of the hole pattern shown in the table of FIG. 4 is coincident with the detection results $X_0$ to $X_5$ of the six times. That is, first, the variable j representing the start position of the hole pattern of the comparative target is initialized ("00") (step S41), and arrangement values $U_j$ to $U_{j+10}$ representing a six successive hole pattern containing the hand position represented by the variable j as a start point are picked up from the second hole pattern data table of ROM 36 (step S42). The arrangement values $U_j$ to $U_{j+10}$ are compared with the detection results $X_0$ to $X_5$ to determine whether they are coincident with each other (step S43). When they are not coincident, it is checked whether the start position of the hole pattern of the comparative target reaches the final position (j=58) (step S44). When the start position does not reach the final position, the value of the variable j is updated to "+2" to displace the start position by two steps (step S45), and the processing returns to the step S42 again. The second hand determining unit is constructed by the loop processing of the steps S42 to S45 described above.

When the detection results $X_0$ to $X_5$ are coincident with the arrangement values $U_j$ to $U_{j+10}$ during the loop processing of the steps S42 to S45 described above, it is understood that the present position of the second hand 2 is the step position of "j+10". Therefore, the count value of the second hand 2 which is being counted in a predetermined area of RAM 37 is corrected to "j+10" (step S46), the detection result is set to "OK" and then the second hand detection processing is finished.

On the other hand, when the start position of the hole pattern of the comparative target reaches the final position (j=58) with the comparison result of the step S43 indicating non-coincidence due to some error, the processing is branched to "YES" side in the judging processing of the step S44, the detection result is set to "NG" and then the second-hand detection processing is finished.

Through the second hand detection processing as described above, the second hand wheel 24 is merely moved by 12 steps and the first detector 31 is merely actuated at six times every two steps, whereby the position detection of the second hand 2 can be executed or it can be checked that the position detection of the second hand 2 is left impossible due to the positional displacement of the minute hand 3 or the hour hand 4.

[Minute Hand Detection Processing]

Figure 16:
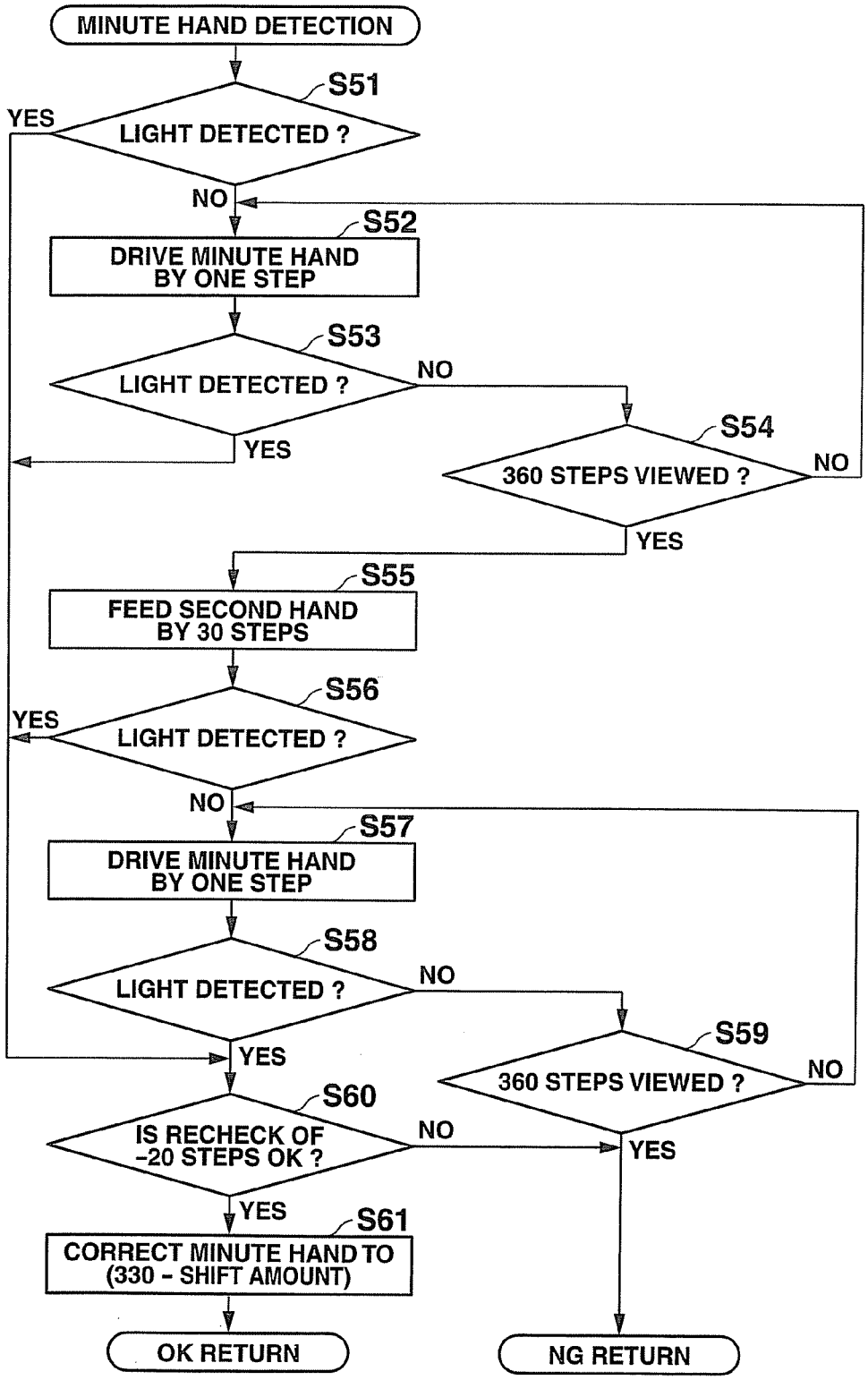
FIG. 16 is a flowchart showing the control procedure of the minute hand detection processing executed in step S4 of FIG. 8.

FIG. 16 is a flowchart showing the minute hand detection processing executed in step S4 of FIG. 8.

The minute hand detection processing executes the position detection of the minute hand 3 and the correction of the count value representing the position of the minute hand 3 under the situation that the position of the minute hand 3 is unclear due to the positional displacement of the hands 2 to 4. The situation that the position of the minute hand 3 is unclear contains a case where the through holes 25*h*, 26*h* of the minute hand wheel 25 and the intermediate wheel 26 are not overlapped with the detection position P, a case where the through holes 24*h*1 to 24*h*7 of the second hand wheel 24 are not overlapped with the detection position P and a case where the hour hand wheel 27 closes the overlap of the through hole at the detection position P.

When the processing shifts to the minute hand detection processing, CPU 10 first actuates the first detector 31 to execute the detection processing (step S51). As a result, when light is detected, it can be judged that the through holes 25*h*, 26*h* of the minute hand wheel 25 and the intermediate wheel 26 are overlapped at the detection position P, and thus the processing directly shifts to step S60.

On the other hand, when no light is detected through the detection processing of the step S51, the detection processing of the first detector 31 is executed (step S53) every time the minute hand 3 is driven by one step (step S52). When no light is detected, it is judged whether the minute hand 3 is rotated by 360 steps (step S54), and these steps are repeated until the minute hand 3 is rotated by 360 steps. When light is detected during this repetitive processing, it can be judged that the through holes 25*h*, 26*h* of the minute hand wheel 25 and the intermediate wheel 26 are overlapped at the detection position P, and thus the processing is shifted to step S60.

On the other hand, when it is judged in the judging processing of the step S54 that the minute hand 3 is rotated by 360 steps, there is assumed a situation that a portion other than the through holes 24*h*1 to 247 of the second hand wheel 24 closes the detection position P, and thus the second hand wheel 24 is rotated by 30 steps (step S55). The second hand wheel 24 is designed so that a through hole necessarily exists at the 180°-opposite side to the portion having no through hole, and thus when the second hand wheel 24 closes the detection position P, any one of the through holes 24*h*1 to 24*h*7 of the second hand wheel 24 is set to be overlapped with the detection position P in the processing of the step S55.

Under this state, the detection processing of the first detector 31 is first executed (step S56),and when light is detected, it can be judged that the through holes 25*h*, 26*h* of the minute hand wheel 25 and the intermediate wheel 26 are overlapped at the detection position P, and thus the processing shifts to the step S60.

Furthermore, when no light is detected through the detection processing of the step S56, the detection processing of the first detector 31 is executed (step S58) every time the minute hand 3 is driven by one step (step S57). When no light is detected, it is judged whether the minute hand 3 is rotated by 360 steps (step S59), and these steps are repeated until the minute hand 3 is rotated by 360 steps. When light is detected during this repetitive processing, it can be judged that the through holes 25*h*, 26*h* of the minute hand wheel 25 and the intermediate wheel 26 are overlapped at the detection position P, and thus the processing is shifted to step S60.

On the other hand, it is judged through the judging processing of the step S59 that the minute hand 3 is rotated by 360 steps, it is judged that the hour hand wheel 27 closes the though hole at the detection position P and thus the minute hand 3 cannot be detected, so that the detection result is set to "NG" and the minute hand detection processing is finished.

When light is detected in the above steps S51, S53, S56, S58 and thus the processing goes to step S60, the second hand 2 is temporarily returned by 20 steps for recheck, and then it is advanced by 20 steps to check whether the same detection result is obtained or not (step S60). When the same detection result is obtained, it is understood that the through holes 25*h*, 26*h* of the minute hand wheel 25 and the intermediate wheel 26 are overlapped at the detection position P at present. Therefore, the count value of the minute hand 3 which is being counted in the predetermined area of RAM 37 is corrected to the corresponding value (step S61), the detection result is set to "OK" and then the minute hand detection processing is finished.

Here, when the minute hand 3 has no assembling error and the hand shift amount is equal to "0°", the correction value of the count value of the minute hand 3 is equal to "330" in terms of step value because the minute hand 3 is located at the position of the specified time "55 minute 00 second". Furthermore, when the minute hand 3 has an assembling error and the hand shift amount for eliminating this error is not equal to "0°", the correction value is equal to a value obtained by increasing or reducing the above value by the amount corresponding to the examination timing correction value stored in the storage unit 35*a* of EEPROM 35. In step S61, CPU 10 calculates the correction value on the basis of the examination timing correction value, and corrects the count value of the minute hand 3.

On the other hand, when the same detection result is not obtained in the recheck of the step S60, it is determined that some error occurs, so that the detection result is set to "NG" and then the minute hand detection processing is finished.

Through the minute hand detection processing as described above, the position detection of the minute hand 3 is executed, or it is determined that the hour hand wheel 27 closes the detection position P and thus the minute hand 3 is set to a state that the position detection of the minute hand 3 is impossible.

[Hour Hand Detection Processing]

Figure 17:
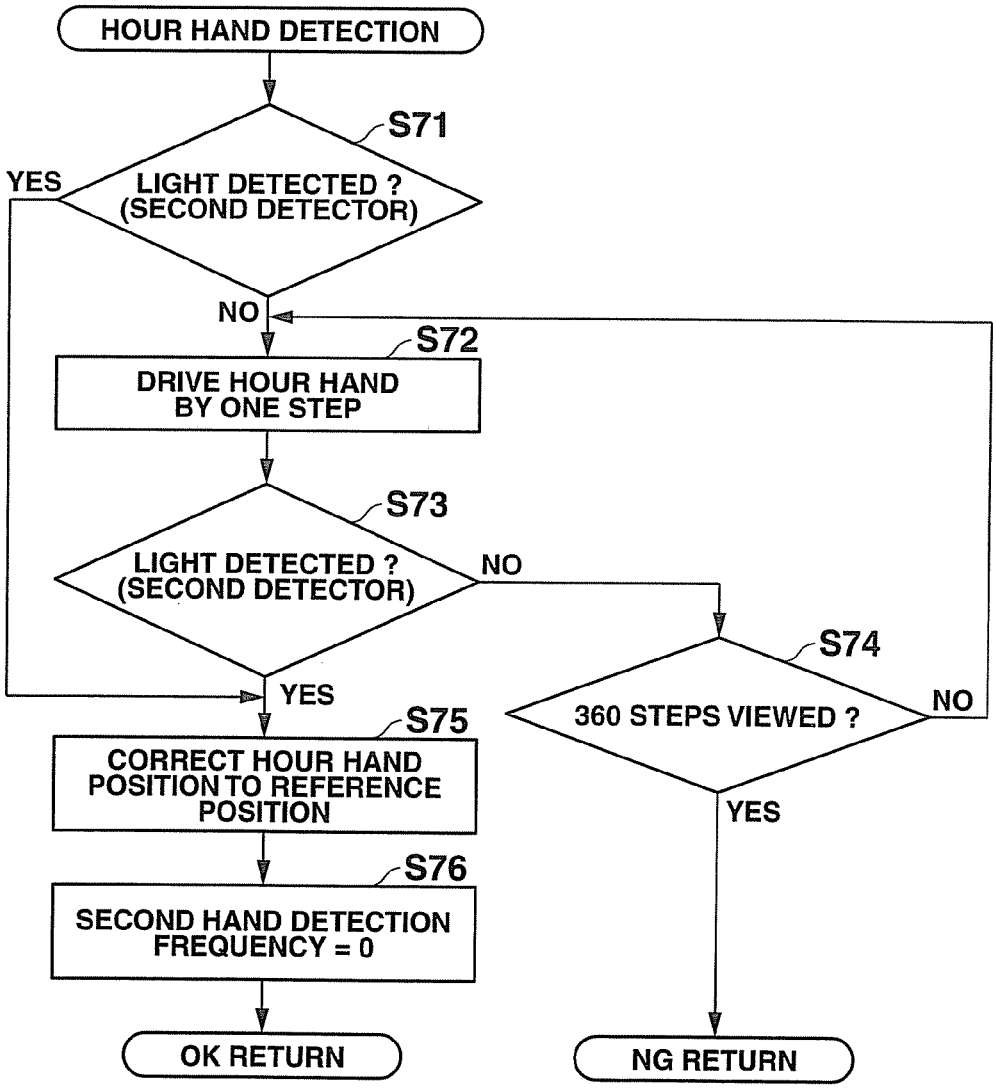
FIG. 17 is a flowchart showing the control procedure of the hour hand detection processing executed in step S7 of FIG. 8.
Figure 18A:
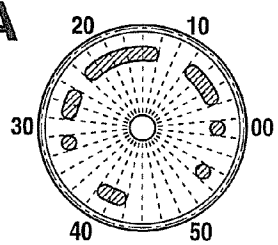
FIGS. 18A to 18C are first to third modifications of a formation pattern of through holes in the second hand wheel and tables showing hole patterns thereof.
Figure 18B:
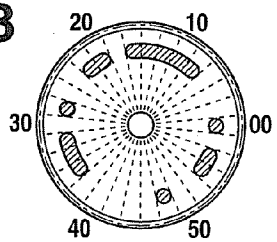
Figure 18C:
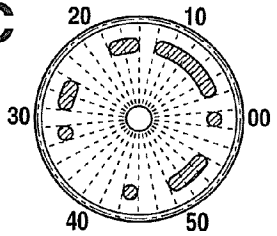
Figure 19A:
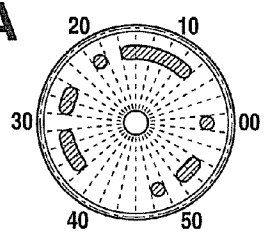
FIGS. 19A to 19D are fourth to seventh modifications of the formation pattern of the through holes in the second hand wheel and tables showing hole patterns thereof.
Figure 19B:
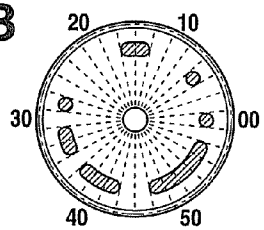
Figure 19C:
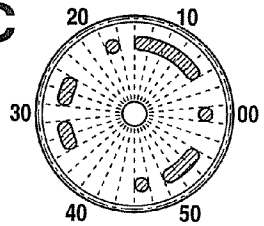
Figure 19D:
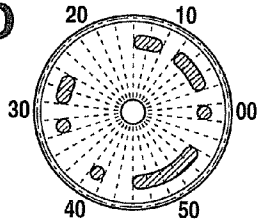
Figure 20A:
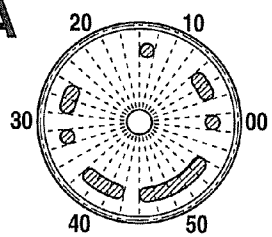
FIGS. 20A to 20D are eighth to eleventh modifications of the formation pattern of the through holes in the second hand wheel and tables showing hole patterns thereof.
Figure 20B:
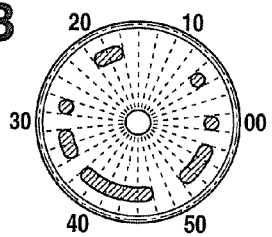
Figure 20C:
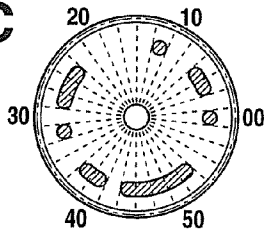
Figure 20D:
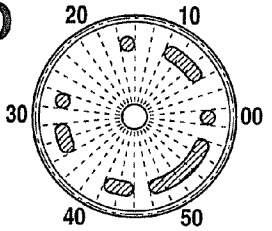
Figure 21A:
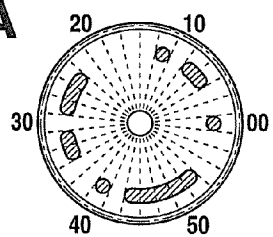
FIGS. 21A to 21D are twelfth to fifteenth modifications of the formation pattern of the through holes in the second hand wheel and tables showing hole patterns thereof.
Figure 21B:
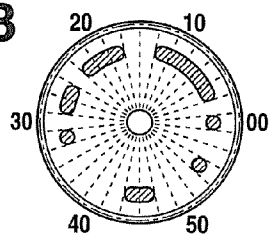
Figure 21C:
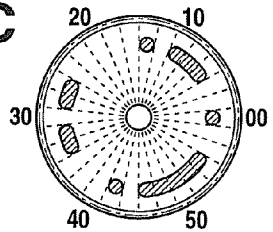
Figure 21D:
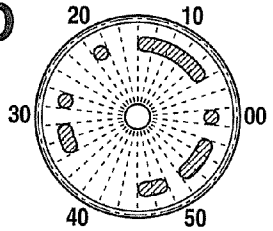
Figure 22A:
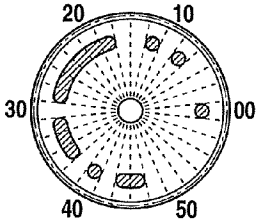
FIGS. 22A to 22C are sixteenth to eighteenth modifications of the formation pattern of the through holes in the second hand wheel and tables showing hole patterns thereof.
Figure 22B:
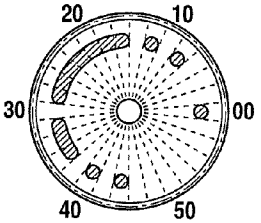
Figure 22C:
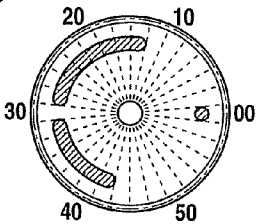
Figure 23A:
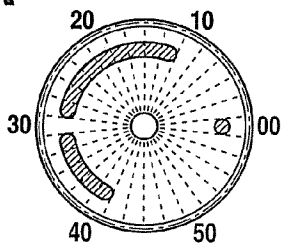
FIGS. 23A and 23B are nineteenth and twentieth modifications of the formation pattern of the through holes in the second hand wheel and tables showing hole patterns thereof.
Figure 23B:
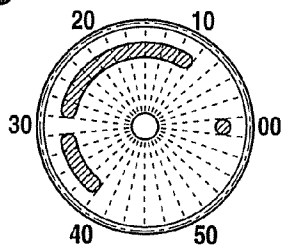

FIG. 17 is a flowchart showing the hour hand detection processing executed in step S7.

According to the hour detection processing, it is checked whether the hour hand examination timing is located at a specified position or not, and position detection of the hour hand 4 and correction of a count value representing the position of the hour hand 4 under the state that the position of the hour hand 4 is unclear are performed.

The position of the hour hand 4 can be detected irrespective of the positions of the second hand 2 and the minute hand 3 by the detection processing of the second detector 32 at the second detection position P2. Accordingly, when the processing shifts to the hour hand detection processing (FIG. 17), CPU 10 first actuates the second detector 32 and judges whether light is detected or not (step S71). When light is detected, it can be judged that the hour hand 4 is located at a reference position (the position of "11 hour 55 minute" of the hour hand scale), and thus the processing directly shifts to step S75.

On the other hand, when no light is detected, the detection processing of the second detector 32 is executed (step S73) every time the hour hand 4 is driven every step by driving the third motor 53 (step S72). When no light is detected, it is judged whether the hour hand 4 is rotated by 360 steps (step S74), and these steps are repeated until the hour hand 4 is rotated by 360 steps. When light is detected during this repetitive process, it can be judged that the hour hand 4 is located at the reference position (the position of "11 hour 55 minute" of the hour hand scale). Therefore, this processing gets out of the repetitive processing, and shifts to step S75.

When the processing shifts to the step S75, CPU 10 corrects the count value of the hour hand 4 being counted in the predetermined area of RAM 37 to a value representing the reference position. Then, CPU 10 substitutes "0" into a variable representing a second hand detection frequency for subsequent-stage processing (step S76), sets the detection result to "OK" and then finishes this hour hand detection processing.

On the other hand, when the hour hand 4 is rotated by 360 steps through the repetitive processing of the steps S72 to S74, CPU 10 determines that the hour hand 4 cannot be detected due to some error, sets the detection result to "NG" and then finishes the hour hand detection processing.

Through the hour hand detection processing described above, when there is no abnormality, the position detection of the hour hand 4 and the correction of the count value representing the position of the hour hand 4 are normally performed.

In the hand position detecting and correcting processing (FIG. 8) described above, the hourly second hand examination (FIG. 9), the second hand detection processing (FIG. 14), the minute hand detection processing (FIG. 16) and the hour hand detection processing (FIG. 17) are performed according to a proper procedure, whereby it is checked whether any positional displacement occurs in the hands 2 to 4 at a predetermined examination timing, and when there is some positional displacement, the correction of the positional error is performed.

As described above, according to the electronic timepiece 1 and the construction of the hand position detection of this embodiment, an angular segment of two steps is set as a unit segment, and the formation pattern of the through holes 24*h*1 to 24*h*7 of the second hand wheel 24 is designed so that all hole patterns of five successive angular segments with each of "00" step, "10" step, "20" step, "30" step, "40" step and "50" step being set as a start point are respectively unique patterns as shown in FIGS. 3 and 4. Furthermore, six kinds of hole patterns containing "00" step, "20" step, "30" step, "40" step or "50" step as the start point do not contain any hole pattern containing all "no hole". Therefore, even when the hourly examination timing is displaced from the specified time (every hour 55 minute 00 second) with 10 seconds being set as a unit due to the assembling error of the minute hand 3, the five-time detection processing (light detection of the first detector 31) is executed from the displaced hourly examination timing, whereby it can be determined from the detected hole pattern whether there is any positional displacement in the second hand 2 or the minute hand 3.

Furthermore, as shown in FIGS. 3 and 4, an angular segment of two steps is set as a unit segment, and the formation pattern of the through holes 24*h*1 to 24*h*7 of the second hand wheel 24 is designed so that all hole patterns each comprising five successive angular segments with any angular segment being set as a head are made different from one another by changing the head angular segment. Accordingly, even under a situation that the position of the second hand 2 is unclear, by executing the detection processing of the through holes of six successive angular segments, the position of the second hand 2 can be detected or it can be determined that the position detection of the second hand 2 cannot be directly performed due to an effect of another hand.

Still furthermore, as shown in FIGS. 3 and 4, the formation pattern of the through holes 24*h*1 to 24*h*7 of the second hand wheel 24 is designed so that an angular segment which is opposite to an angular segment having no through hole by 180° has necessarily a through hole. Accordingly, when it is estimated that the second hand wheel 24 closes the through hole and thus the position of the minute hand 3 cannot be detected during the minute hand detection processing, any one of the through holes 24*h*1 to 24*h*7 of the second hand wheel 24 can be located at the detection position P by rotating the second hand wheel 24 half, thereby allowing the minute hand 3 to be subjected to the position detection.

According to the electronic timepiece 1 and the construction of the hand position detection thereof, the detection position P is set to the position at which the minute hand wheel 25 and the intermediate wheel 26 are overlapped with each other, and when the minute hand 3 reaches a predetermined step position, the through holes 25*h*, 26*h* of the minute hand wheel 25 and the intermediate wheel 26 are overlapped with the detection position P, and when the minute hand 3 is moved before and after a predetermined step position by one step, the intermediate wheel 26 greatly rotates, and closes the overlap of the through hole at the detection position P. Therefore, on the assumption of this construction, in order to examine the presence or absence of the positional displacement of the second hand 2 and the minute hand 3 while the normal hand driving operation is executed, it is necessary to determine the pattern of the through holes of the second hand wheel 24 during the period (ten seconds in this embodiment) from the time when the minute hand 1 reaches a predetermined step position until the time when the minute hand 1 is driven by one step. The second hand wheel 24 of this embodiment is designed so that all patterns of the through holes corresponding to ten steps by which the second hand wheel 24 is rotated are made different from one another by changing the start point thereof during the period of 10 seconds or lightly less when the minute hand 3 is stopped. Accordingly, the pattern of the through holes of the second hand wheel 24 is determined during the period when the minute hand 1 is stopped under normal driving operation, whereby the positional displacement of the second hand 2 and the minute hand 3 can be examined.

In the electronic timepiece 1 of this embodiment, the minute hand 3 is driven by one step in ten seconds, and thus the electronic timepiece 1 is designed so that the pattern of the through holes of the angular range corresponding to ten steps of the second hand wheel 24 is varied in accordance with the start point. However, when the minute hand 3 is driven by one step in 20 seconds, the electronic timepiece 1 is designed so that the pattern of the through holes of the angular range of 20 steps of the second hand wheel 24 is varied in accordance with the start point, whereby the same action and effect as described can be obtained.

Furthermore, according to the electronic timepiece 1 and the construction of the hand position detection of this embodiment, an examination timing correction value representing how long the hourly examination timing at which the through holes 25*h*, 26*h* of the minute hand wheel 25 and the intermediate wheel 26 are expected to be overlapped at the detection position P is displaced from the specified time (55 minute 00 second) is stored in the storage unit 35*a* of EEPROM 35, and also second hole pattern specifying data for specifying a pattern of the through holes of the second hand wheel 24 to be detected from the hourly examination timing by 10 steps in connection with the above displacement is stored in the storage unit 35*b* of EEPROM 35. In the hand position detecting and correcting processing, CPU 10 corrects the hourly examination timing in accordance with the examination timing correction value, and properly selects a second hole pattern to be compared with the detection pattern of the through holes at the hourly examination timing in accordance with the second hole pattern specifying data. Accordingly, when the minute hand 3 has an assembling error, the value corresponding to the assembling error is appropriately set in the storage units 35*a*, 35*b*, whereby the proper hourly second hand examination processing can be performed at the proper examination timing without changing the algorithm.

According to the electronic timepiece 1 and the construction of the hand position detection of this embodiment, the second hole pattern data table in which the pattern of the through holes 24*h*1 to 24*h*7 of the second hand wheel 24 and the step position of the second hand 2 are associated with each other is stored in the storage unit 36*a* of ROM 36. Furthermore, in the second hand detection processing (FIG. 14), CPU 10 detects the through hole pattern corresponding to 12 steps of the second hand wheel 24, and collates this detection value with the values of the second hole pattern table to determine the position of the second hand 2. Accordingly, even when the second hand 2 is located at any position, the position of the second hand 2 can be detected by the same processing operation and the same processing time.

Furthermore, according to the electronic timepiece 1 and the construction of the hand position detection of this embodiment, light is irradiated from the opposite side to the photosensor 312 by the light emitting unit 311 while the second hand wheel 24, the minute hand wheel 25, the intermediate wheel 26 and the hour hand wheel 27 are sandwiched between the photosensor 312 and the light emitting unit 311, so that a constant amount of light is obtained and the overlap state of the through holes can be accurately judged.

The formation pattern of the through holes of the second hand wheel 24 is not limited to that of FIG. 3, and many modifications may be applied. FIGS. 18A to 23B show first to twentieth modifications of the formation pattern of the through holes of the second hand wheel 24 and tables showing these hole patterns.

The first to fifteenth modifications shown in FIGS. 18A to 21D satisfy the first condition that a through hole necessarily exists in an angular segment which is located at 180° opposite side to an angular segment having no through hole, and the second condition that hole patterns each comprising five segments successive from any angular segment are made different from one another by changing the angular segment at the head. Even when the second hand wheels of the first to fifteenth modifications are applied to the second hand wheel 24 of the above embodiment, the same action and effect as the above embodiment can be achieved. In the case of the application of the second hand wheels of the first to fifteenth modifications, the second hand 2 may be assembled so that a portion having a through hole formed in only one angular segment is overlapped with the detection position P when the second hand 2 is located at the reference position (for example, 00 second position)

The sixteenth to twentieth modifications shown in this order in FIGS. 22A to 22C, FIG. 23A and FIG. 23B satisfy the first condition that a through hole necessarily exists in an angular segment which is located at 180° opposite side to an angular segment having no through hole, and are designed so that hole patterns each comprising N segments successive from any angular segment (a sixth segment in the sixteenth modification, a seventh segment in the seventeenth modification, an eighth segment in the eighteenth modification, a ninth segment in the nineteenth modification, a tenth segment in the twentieth modification) are made different from one another by changing the angular segment at the head. That is, the rotational position of the second hand wheel can be specified by viewing the hole patterns of the N segments.

It is preferable that the N value is smaller, and as the N value is smaller, the check of the positional displacement of the second hand 2 and the position detection of the second hand 2 can be performed by executing the detection processing of the through holes at a smaller frequency. Furthermore, when the minute hand 3 is of 20-second hand driving type, the second hand wheel 24 rotates by 20 steps during the period when the minute hand 3 is stopped under normal hand driving operation. Therefore, even when the sixteenth to twentieth modifications are applied, the positional displacement of the second hand 2 can be examined by detecting the hole pattern of the second hand wheel 24 during the period when the minute hand 3 is stopped. However, when the minute hand 24 is of 10-second hand driving type, the second hand wheel 24 is moved by only 10 steps during the period when the minute hand 3 is stopped under normal hand driving operation, and thus it is necessary to apply the first to fifteenth modifications in which all the hole patters each comprising five successive segments are different from one another.

The present invention is not limited to the above embodiment, and various modifications may be made. For example, in the above embodiment, the minute hand wheel 25 is applied as the first gear which is rotated interlockingly with the minute hand 3 and has through holes, and the second hand wheel 24 is applied as the second gear which is rotated interlockingly with the second hand 2 and has through holes. However, gears which are assembled at other positions as a first gear and a second gear may be applied insofar as they likewise rotate about the same rotational axis interlockingly with the minute hand 3 and the second hand 2.

In the above embodiment, the through holes through which light is transmitted are applied as the first to third detection target portions which can be identified by light irradiation. However, for example, two of the first to third detection target portions are provided as through holes at one side, and one of them is provided as a reflection face at the other side, light is irradiated from the through holes and light which is reflected from the reflection face and returned is detected, whereby it is judged whether the first to third detection target portions are overlapped at the detection position.

Furthermore, in the above embodiment, each of the through holes 24*h*2, 24*h*3, 24*h*5, 24*h*7 which are formed over a plurality of successive angular segments of the second hand wheel 24 is formed as an elongated hole which is continuous over a plurality of angular segments. However, the through hole is not necessary to be an elongated hole, and one through hole may be formed in each of a plurality of successive angular segments so that through holes are continuous with one another over a plurality of angular segments.

Still furthermore, in the above embodiment, for the purpose of enabling examination of the positional displacement of the minute hand 3 and the second hand 2 according to the same algorithm even when the hourly examination timing is varied due to an assembling error of the minute hand 3, the second hand wheel having through holes which have the feature according to the present invention is applied. However, the present invention may be applied for another purpose. For example, the second hand wheel having the through holes which have having the feature of the present invention is applied when the reference position (the position of 00 minute 00 second) of the minute hand 3 and the second hand 2 is used while displaced laterally from the upper end side of the dial by a predetermined angle such as 30° or the like, thereby achieving an effect that the positional displacement of the minute hand 3 or the second hand 2 can be examined according to the same algorithm in connection with the variation of the hourly examination timing based on the change of the reference position.

Still furthermore, in the above embodiment, the examination timing correction value which represents a correction amount in terms of the number of seconds is exemplified as correction data which can specify the hourly examination timing at which the through hole 25*h* of the minute hand wheel 25 is expected to be overlapped with the detection position P. However, data which are formatted to represent the same correction amount with an angle or the number of steps of the minute hand may be used. Alternatively, data which directly represents the corrected examination timing such as "54 minute 50 second", "55 minute 20 second" or the like.

The details of the construction and the control processing according to the above embodiment may be arbitrarily modified without departing from the subject matter of the present invention.

What is claimed is:

1. A hand position detecting device comprising:

a first gear rotating interlockingly with a minute hand;

a second gear rotating interlockingly with a second hand and rotating about a same rotational axis as the first gear;

a first detection target portion that is provided at a predetermined radial position of the first gear and identifiable by light irradiation;

a second detection target portion that is provided at a radial position of the second gear so as to be overlapped with the first detection target portion and identifiable by light irradiation; and a detector for detecting on the basis of irradiated light whether the first detection target portion and the second detection target portion are set to be overlapped with each other at a predetermined detection position, wherein the second detection target portion is formed to be divided into a plurality of parts over a predetermined angular range out of a center angle of 360° of the second gear, and a presence-or-absence pattern of the second detection target portion in an angular range of successive N (N represents one of 5 to 10) angular segments each having a center angle of 12° with any angular segment being set as a start point is made different when the angular segment of the start point is different.

2. An electronic timepiece having the hand position detecting device according to claim 1.

3. The hand position detecting device according to claim 1, wherein the second detection target portion is formed as a pattern in which the second detection target portion exists in an angular range at a 180° opposite side to an angular range having no second detection target portion.

4. An electronic timepiece having the hand position detecting device according to claim 3.

5. The hand position detecting device according to claim 3, wherein the second detection target portion comprises one five-successive portion formed over five successive segments with each segment being set to have a center angle 12° of the second gear as a unit, one three-successive portion formed over three successive segments, two two-successive portions formed over two successive segments, and three one-successive portions each of which is formed in only one segment, and in the second gear the one five-successive portion, the one three-successive portion, the two two-successive portions and the three one-successive portions are arranged in predetermined angular ranges so that an angular range in which the second detection target portion does not exist over successive five segments with each segment being set to have a center angle 12° as a unit, an angular range in which the second detection target portion does not exist over successive three segments, two angular ranges in each of which the second detection target portion does not exist over successive two segments, and three angular ranges in each of which the second detection target portion does not exist over one segment are respectively sandwiched between the successive portions.

6. An electronic timepiece having the hand position detecting device according to claim 5.

7. The hand position detecting device according to claim 1, further comprising:

a third gear that is rotated interlockingly with the first gear and partially overlapped with the first gear at the detection position; and a third detection target portion that is provided at a radial position overlapped with the detection position of the third gear and identifiable by light irradiation, wherein the detector is configured to detect whether all the first to third detection target portions are overlapped or not at the detection position, and the first gear and the third gear are configured so that the first detection target portion and the third detection target portion are overlapped with each other at the detection position when the minute hand is located at a predetermined step position, and the first detection target portion and the third detection target portion are not overlapped with each other at the detection position when the minute hand is located at a step position before or after the predetermined step position.

8. An electronic timepiece having the hand position detecting device according to claim 7.

9. The hand position detecting device according to claim 1, wherein the second hand and the second gear make one round by rotation of 60 steps.

10. The hand position detecting device according to claim 9, wherein the minute hand and the first gear make one round by rotation of 360 steps or 180 steps.

11. An electronic timepiece having the hand position detecting device according to claim 9.

12. The hand position detecting device according to claim 1, further comprising:

a correction data storage unit for storing correction data with which a minute hand examination position at which the minute hand is located when the first detection target portion is overlapped with the detection position can be specified;

a specifying data storage unit for storing pattern specifying data with which a presence-or-absence pattern of the second detection target portion overlapped with the detection position can be specified when the second hand is rotated over an angular range of the N angular segments from a position of the second hand corresponding to a second digit value of a display time at which the minute hand indicates the minute hand examination position;

a first detection controller for making the detector execute a detecting operation during a period when the second gear rotates over an angular range of the N angular segments from a timing at which the minute hand is assumed to reach the minute hand examination position; and a judging unit for judging whether a detection result of the detecting operation of the first detection controller is coincident with a presence-or-absence pattern of the second detection target portion specified on the basis of the pattern specifying data.

13. An electronic timepiece having the hand position detecting device according to claim 12.

14. The hand position detecting device according to claim 12, wherein the first detection controller makes the detector execute the detecting operation every time the second gear rotates by an amount corresponding to the one angular segment.

15. An electronic timepiece having the hand position detecting device according to claim 14.

16. The hand position detecting device according to claim 1, further comprising:

a pattern data storage unit for storing pattern data in which a presence-or-absence pattern of the second detection target portion overlapped with the detection position and a position of the second hand are associated with each other;

a second detection controller for making the detector execute a detecting operation during a period when the second gear rotates over an angle range of the N angular segments or (N+1) angular segments; and a secondhand determining unit for collating a detection result of the detecting operation of the second detection controller with the pattern data to determine a position of the second hand.

17. The hand position detecting device according to claim 16, wherein the second detection controller makes the detector execute the detecting operation every time the second gear rotates by an amount corresponding to the one angular segment.

18. An electronic timepiece having the hand position detecting device according to claim 16.

19. The hand position detecting device according to claim 1, further comprising a light emitting unit for emitting light from an opposite side to the detector while the first gear and the second gear are sandwiched between the detector and the light emitting unit, wherein the first detection target portion and the second detection target portion are light transmissible portions through which light is transmitted, and the detector detects light which is emitted from the light emitting unit and passed through the first detection target portion and the second detection target portion.

20. An electronic timepiece having the hand position detecting device according to claim 19.

* * * * *